US007771202B2

(12) United States Patent
Amotz et al.

(10) Patent No.: US 7,771,202 B2
(45) Date of Patent: Aug. 10, 2010

(54) APPARATUS FOR TRANSFERRING ALTERNATING CURRENT ELECTRICAL POWER

(76) Inventors: Einam Yitzhak Amotz, 11 Rabi Mair st., Jerusalem (IL) 93185; Arnon Haim David, 6 Ankor St., Ramat Hasharon (IL) 47229

( * ) Notice: Subject to any disclaimer, the term of this patent is extended or adjusted under 35 U.S.C. 154(b) by 0 days.

(21) Appl. No.: 12/343,464

(22) Filed: Dec. 23, 2008

(65) Prior Publication Data

US 2009/0176383 A1 Jul. 9, 2009

Related U.S. Application Data

(60) Provisional application No. 61/019,301, filed on Jan. 7, 2008.

(51) Int. Cl.
*H01R 11/30* (2006.01)

(52) U.S. Cl. ..... 439/39

(58) Field of Classification Search ..... 439/38, 439/39, 40, 152, 188; 200/51.09
See application file for complete search history.

(56) References Cited

U.S. PATENT DOCUMENTS 3,521,216 A * 7/1970 Tolegian ..... 439/39
4,156,265 A 5/1979 Rose
4,442,327 A * 4/1984 West et al. ..... 200/51 R
4,451,113 A 5/1984 Zuniga
4,647,778 A 3/1987 Kline
4,874,316 A 10/1989 Kamon et al.
5,401,175 A 3/1995 Guimond et al.
5,507,303 A * 4/1996 Kuzma ..... 128/899
5,816,825 A 10/1998 Sekimori et al.
5,829,987 A * 11/1998 Fritsch et al. ..... 439/38
5,921,783 A 7/1999 Fritsch et al.
5,954,520 A 9/1999 Schmidt
6,007,363 A 12/1999 Renk
6,213,783 B1 4/2001 Kankkunen
6,217,339 B1 4/2001 Tsubata
6,527,570 B1 3/2003 Hartman et al.
6,719,576 B2 4/2004 Hartman et al.
6,962,498 B2 11/2005 Kohen
6,966,781 B1 11/2005 Bullinger et al.
7,264,479 B1 9/2007 Lee
7,311,526 B2 12/2007 Rohrbach et al.
7,344,380 B2 3/2008 Neidlein et al.
7,351,066 B2 4/2008 DiFonzo et al.

* cited by examiner

*Primary Examiner*—Chandrika Prasad

(57) ABSTRACT

An apparatus and method for transferring power from a stationary unit to a mobile unit are introduced in order to improve on the existing methods of supplying power to appliances and mobile devices.

The stationary unit is comprised of multiple magnetic and electromagnetic switches, which are activated only when in close proximity to a mobile unit comprising of a set of magnets of opposite polarity to the magnetic and electromagnetic switches in the stationary unit thus ensuring a safe and easy to use system for supplying power from the stationary unit to the mobile unit.

The stationary unit may be large enough to allow the connection of multiple mobile units on a single stationary unit. Each mobile unit can then adjust the voltage supplied by the stationary to fit the requirements of its own appliance or mobile device thus allowing different types of devices to connect to the same source (the stationary unit).

12 Claims, 22 Drawing Sheets

APPARATUS FOR TRANSFERRING ALTERNATING CURRENT ELECTRICAL POWER

REFERENCE TO CROSS-RELATED APPLICATION

This application claims priority from U.S. Provisional Application No. 61/019,301, filed on Jan. 7, 2008, herein incorporated by reference in its entirety.

FIELD OF THE INVENTION

The present invention relates to an apparatus and method for transferring electrical power from a source plane to a receiving device placed in various orientations on this plane.

BACKGROUND OF THE INVENTION

Many of today's electronic devices are portable and some of them are even equipped with rechargeable batteries.

If a battery less electronic device is used, it must be connected to a power supply, i.e. 110V/220V AC power outlet.

When an electronic device equipped with rechargeable batteries is being used, the operating time of the device is limited to the available charge provided by at least one rechargeable battery. After the depletion of the batteries, the device must be connected to a power supply, i.e. 110V/220V AC power outlet in order to continue to operate and to recharge the batteries in the device.

There are a number of problems associated with conventional means of powering or charging these devices:

- The devices have to be plugged into mains 110V/220V AC power outlet and hence if several are used together, they take up space in plug strips and create a messy and confusing tangle of wires.
- The locations of the power outlets are fixed and the number of outlets is usually limited.

U.S. Pat. No. 3,521,216, (1970), which is incorporated by reference for all purposes as if fully set forth herein, taught the use of plug and socket assembly incorporating magnetic means for attracting and holding a plug in a socket.

There is thus a widely recognized need for, and it would be highly advantageous to have a power outlet plug and socket that do not require any alignment at all.

The prior art does not teach or suggest such a tool.

SUMMARY OF THE INVENTION

An apparatus for transferring electrical power from a source plane, to one receiving device or to a plurality of receiving devices placed in various orientations on this source plane according to the present invention can overcome the described limitations.

The apparatus includes a planar stationary unit and at least one mobile unit.

According to one embodiment the planar stationary unit includes conductive plates embedded in the form of a grid in a non-conductive matrix.

An example for the matrix material could be plastic but the matrix could be made of any material that is non-conductive.

An example for the conductive plates embedded in the matrix material could be copper, but the conductive plates embedded in the matrix could be made of any material that is conductive.

Each of the plates is connected to a power grid through a switch that is normally open. i.e., there is no voltage on the plates.

Half of the plates are connected to the phase port of the electrical power grid and the other half are connected to the zero port of the electrical power grid.

The plates are arranged in grid formation so that the four nearest neighboring plates of each plate are connected to the opposite port as the port that the plate itself is connected to.

All the switches of the phase port are connected to a signal-receiving device and they can be turned on if in their proximity there is a device that transmits a specific signal to the receiving device.

This transmitting device can transmit the signal (or code) through any form of transmission such as magnetic transmission, electromagnetic transmission, electrostatic transmission (capacitance), radio frequency (RF) transmission etc.

All of the switches of the zero port are connected to a signal-receiving device and they can be turned on if in their proximity there is a device that transmits a specific signal (or code) to the receiving device.

This transmitting device can transmit the signal (or code) through any form of transmission such as magnetic transmission, electromagnetic transmission, electrostatic transmission (capacitance), radio frequency (RF) transmission etc.

The phase port switch cannot be turned on by the same transmission that turns on the zero port switches and the zero port switches cannot be turned on by the same transmission that turns on the phase port switches.

According to the above embodiment, a mobile unit that is comprised of two large conductive plates is embedded in a planar and non-conductive frame.

The plates in the mobile unit are significantly bigger than the distances between the plates in the planar stationary unit so that if placed on the planar stationary unit, each of the two plates in the mobile unit covers several plates embedded in the planar stationary unit.

The distance between the plates in the mobile unit is greater than the largest dimension of the plates in the planar stationary unit so that no plate in the planar stationary unit can be in contact with both plates in the mobile unit.

The width of the non-conductive frame surrounding the conductive plates is greater than the largest dimension of the plates in the planar stationary unit so that no plate in the planar stationary unit can touch a plane and extend beyond the frame at the same time. This is required for safety reasons: it is not permissible that a live plate would be exposed; hence, the mobile unit must cover it.

Behind each plate in the mobile unit there is a transmitting device as mentioned before.

Each transmitting device in the mobile unit is transmitting a different signal (or code).

One transmitting device is transmitting the signal (or code) that causes the phase port switches to turn on.

The opposite transmitting device is transmitting the signal (or code) that causes the zero port switches to turn on.

The plate that has the transmitting device that is transmitting the signal (or code) that causes the phase port switches to turn on is called the "phase plate".

The plate that has the transmitting device that is transmitting the signal (or code) that causes the zero port switches to turn on is called the "zero plate".

Following is a summary of the stages of the method according to the present invention:

When the mobile unit is placed on the planar stationary unit, both its zero plate and the phase plate are in contact with plates that are connected to the phase port and with plates that are connected to the zero port in the stationary unit.

Of the plates that are in contact with the phase plate, only the switches that are connected to the phase port are switched on and thus an electrical connection is established between the phase plate and the phase port through the live plates.

Of the plates that are in contact with the zero plate, only the switches that are connected to the zero port are switched on and thus an electrical connection is established between the zero plate and the zero port through the live plates.

When any other device or being touches the planar stationary unit, and is in contact with the plates, it is not in electrical contact with the phase port or the zero port because the switches between the plates and the phase and zero ports are not on, thus, the exposed plates in the stationary unit are not "live" and are safe to touch.

According to the present invention there is provided an apparatus for transferring electrical power including: (a) a planar stationary unit phase, ground, and zero assembly set including: (i) at least one planar stationary unit phase switch assembly including: a planar stationary unit phase assembly housing having a first end and a second end, and having cylindrical walls; a planar stationary unit phase assembly contact element disposed at the planar stationary unit phase assembly housing first end; a planar stationary unit phase switch assembly shaft securely connected to the planar stationary unit phase assembly contact element; a planar stationary unit phase assembly voltage element mounted on the planar stationary unit phase switch assembly shaft, having movement capability along at least part of the planar stationary unit phase switch assembly shaft; and a planar stationary unit phase assembly magnet mounted on the planar stationary unit phase switch assembly shaft, having movement capability along at least part of the planar stationary unit phase switch assembly shaft; (ii) at least one planar stationary unit zero assembly including: a planar stationary unit zero assembly housing having first end and second end, having cylindrical walls; a planar stationary unit zero assembly contact element disposed at the planar stationary unit zero assembly housing first end; a planar stationary unit zero assembly shaft securely connected to the planar stationary unit zero assembly contact element; a planar stationary unit zero assembly voltage element mounted on the planar stationary unit zero assembly shaft, having movement capability along at least part of the planar stationary unit zero assembly shaft; and a planar stationary unit zero assembly magnet mounted on the planar stationary unit zero assembly shaft, having movement capability along at least part of the planar stationary unit zero assembly shaft; and (iii) at least one planar stationary unit ground element wherein a planar stationary unit ground element wire is disposed at the planar stationary unit ground element, wherein the planar stationary unit phase assembly magnet has a planar stationary unit phase assembly magnet first magnetic pole and a planar stationary unit phase assembly magnet second magnetic pole, wherein the planar stationary unit zero assembly magnet has a planar stationary unit zero assembly magnet first magnetic pole, a planar stationary unit zero assembly magnet second magnetic pole, wherein the planar stationary unit phase assembly magnet first magnetic pole and the planar stationary unit zero assembly magnet first magnetic pole, are inversely situated, wherein the planar stationary unit phase, ground, and zero assembly set have planar surface, and wherein the planar stationary unit phase switch assembly, the planar stationary unit zero assembly and the planar stationary unit ground element are geometrically coupled to the planar surface.

According to the present invention there is provided an apparatus for transferring DC electrical power including: (a) a planar stationary unit plus and minus assembly sets grid including: (i) at least one planar stationary unit phase switch assembly including: a planar stationary unit phase assembly housing having a first end and a second end, having cylindrical walls; a planar stationary unit phase assembly contact element disposed at the planar stationary unit phase assembly housing first end; a planar stationary unit phase switch assembly shaft securely connected to the planar stationary unit phase assembly contact element (10*a*); a planar stationary unit phase assembly voltage element mounted on the planar stationary unit phase switch assembly shaft, having movement capability along at least part of the planar stationary unit phase switch assembly shaft; and a planar stationary unit phase assembly magnet mounted on the planar stationary unit phase switch assembly shaft, having movement capability along at least part of the planar stationary unit phase switch assembly shaft; and (ii) at least one planar stationary unit zero assembly including: a planar stationary unit zero assembly housing having first end and second end, having cylindrical walls; a planar stationary unit zero assembly contact element disposed at the planar stationary unit zero assembly housing first end; a planar stationary unit zero assembly shaft securely connected to the planar stationary unit zero assembly contact element; a planar stationary unit zero assembly voltage element mounted on the planar stationary unit zero assembly shaft, having movement capability along at least part of the planar stationary unit zero assembly shaft; and a planar stationary unit zero assembly magnet mounted on the planar stationary unit zero assembly shaft, having movement capability along at least part of the planar stationary unit zero assembly shaft, wherein the planar stationary unit phase assembly magnet has a planar stationary unit phase assembly magnet first magnetic pole and a planar stationary unit phase assembly magnet second magnetic pole wherein the planar stationary unit zero assembly magnet has a planar stationary unit zero assembly magnet first magnetic pole, a planar stationary unit zero assembly magnet second magnetic pole, wherein the planar stationary unit phase assembly magnet first magnetic pole and the planar stationary unit zero assembly magnet first magnetic pole, are inversely situated, wherein the planar stationary unit phase, ground, and zero assembly set has planar surface, wherein the planar stationary unit phase switch assembly, and the planar stationary unit zero assembly are geometrically coupled to the planar surface, and wherein d1 is a largest length dimension of the planar stationary unit zero assembly cross section area.

According to the present invention there is provided an apparatus for transferring AC electrical power including: (a) a concentric mobile unit including: (i) a concentric mobile unit body having a cylindrical wall and a flat base surface, having a pre-selected outer diameter value; (ii) a concentric mobile unit ground contact element disposed concentrically inside the concentric mobile unit body at the base, having the pre-selected outer diameter value; (iii) a concentric mobile unit phase contact element disposed concentrically inside the concentric mobile unit body at the base; (iv) a concentric mobile unit zero contact element disposed concentrically inside the concentric mobile unit body at the base: (v) a concentric mobile unit ground magnet disposed concentrically inside the concentric mobile unit body, having a pre-selected outer diameter value; (vi) a concentric mobile unit phase magnet disposed concentrically inside the concentric mobile unit body, having a pre-selected outer diameter value:

and a concentric mobile unit zero magnet disposed concentrically inside the concentric mobile unit body, having a preselected outer diameter value.

BRIEF DESCRIPTION OF THE DRAWINGS

The invention is herein described, by way of example only, with reference to the accompanying drawings, wherein:

FIG. 12*c* is a schematic electrical diagram of a single column of assemblies of the 1-D strip stationary unit according to the present invention, switched on.

FIG. 12*f* is a schematic electrical diagram of a single column of assemblies of the 1-D strip stationary unit according to the present invention, switched on.

FIG. 17*d* is a schematic electrical diagram of a single column of assemblies of the 2-D array stationary unit according to the present invention, switched on.

FIG. 17*e* is a schematic electrical diagram of a single column of assemblies of the 2-D array stationary unit according to the present invention, switched on.

FIG. 17*f* is a schematic electrical diagram of a single column of assemblies of the 1-D strip stationary unit according to the present invention, switched on.

DETAILED DESCRIPTION OF EMBODIMENTS

Figure 1A:
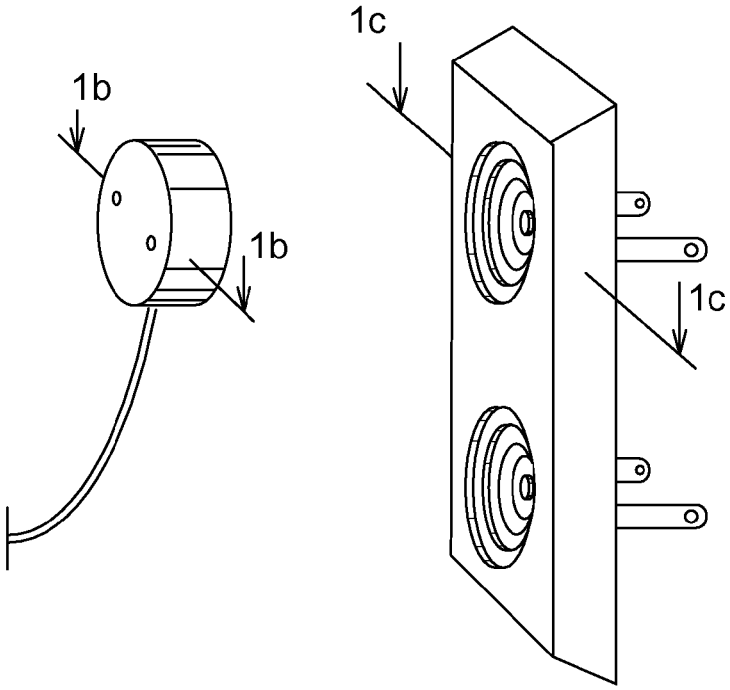
FIG.1a PRIOR ART
FIG. 1*a* of the prior art illustrates an exploded perspective view of a plug upon which the section plane 1*b*-1*b* is marked, and socket assembly upon which the section plane 1*c*-1*c* is marked, showing the plug disconnected from the socket according to U.S. Pat. No. 3,521,216.

The present invention is an apparatus and method for transferring electrical power from a source plane to a receiving device placed in various orientations on this plane.

The principles and operation of an apparatus and method for transferring electrical power from a source plane to a receiving device placed in various orientations on this plane according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings.

Unless otherwise defined, all technical and scientific terms used herein have the same meaning as commonly understood by one of ordinary skill in the art to which this invention belongs. The materials, dimensions, methods, and examples provided herein are illustrative only and are not intended to be limiting.

The following is a list of legend of the numbering of the application illustrations:

| | |
|---|---|
| 10 | planar stationary unit phase switch assembly |
| 10a | planar stationary unit phase assembly contact element |
| 10b | planar stationary unit phase assembly voltage element |
| 10ba | planar stationary unit phase assembly voltage element base |
| 10bb | planar stationary unit phase assembly voltage element wall |
| 10c | planar stationary unit phase switch assembly shaft |
| 10e | planar stationary unit phase assembly magnet |
| 10f | planar stationary unit phase assembly magnet spring |
| 10g | planar stationary unit phase assembly voltage element spring |
| 10h | planar stationary unit phase assembly housing |
| 10i | planar stationary unit phase assembly housing end disk |
| 10j | planar stationary unit phase wire |
| 10l | planar stationary unit phase switch assembly symmetry axis |
| 10m | planar surface |
| 10n | pipe |
| 10x | planar stationary unit phase assembly magnet first magnetic pole |
| 10y | planar stationary unit phase assembly magnet second magnetic pole |
| 11 | planar stationary unit zero assembly |
| 11a | planar stationary unit zero assembly contact element |
| 11b | planar stationary unit zero assembly voltage element |
| 11c | planar stationary unit zero assembly shaft |
| 11e | planar stationary unit zero assembly magnet |
| 11f | planar stationary unit zero assembly magnet spring |
| 11g | planar stationary unit zero assembly voltage element spring |
| 11h | planar stationary unit zero assembly housing |
| 11i | planar stationary unit zero assembly housing end disk |
| 11j | planar stationary unit zero wire |
| 11l | planar stationary unit zero assembly symmetry axis |
| 11x | planar stationary unit zero assembly magnet first magnetic pole |
| 11y | planar stationary unit zero assembly magnet second magnetic pole |
| 12 | planar stationary unit ground element |
| 12j | planar stationary unit ground element wire |
| 20 | mobile unit phase assembly |
| 20a | mobile unit assembly phase assembly contact element |
| 20e | mobile unit phase assembly magnet |
| 20h | mobile unit phase assembly housing |
| 20i | mobile unit phase assembly housing end disk |
| 20j | mobile unit phase assembly phase wire |
| 20l | mobile unit phase assembly symmetry axis |
| 20x | mobile unit phase assembly magnet first magnetic pole |
| 20y | mobile unit phase assembly magnet second magnetic pole |
| 21 | mobile unit zero assembly |

-continued

| | |
|---|---|
| 21a | mobile unit zero assembly contact element |
| 21e | mobile unit zero assembly magnet |
| 21h | mobile unit zero assembly housing |
| 21i | mobile unit zero assembly housing end disk |
| 21j | mobile unit zero assembly phase wire |
| 21l | mobile unit zero assembly symmetry axis |
| 21x | mobile unit zero assembly magnet first magnetic pole |
| 21y | mobile unit zero assembly magnet second magnetic pole |
| 22 | mobile unit ground element |
| 22j | mobile unit ground element wire |
| 31 | 1-D apparatus for transferring electrical power element |
| 31a | magnetic switch |
| 31b | electro-magnetic switch |
| 31fg | floating pad |
| 31g | ground element |
| 31p | phase element |
| 31z | zero element |
| 32 | 1-D strip stationary unit ground assembly |
| 32a | 1-D strip stationary unit ground assembly contact element |
| 32aa | concentric mobile unit zero contact element |
| 32aj | concentric mobile unit zero wire |
| 32ax | concentric mobile unit zero magnet first magnetic pole |
| 32ay | concentric mobile unit zero magnet second magnetic pole |
| 32b | 1-D strip stationary unit ground assembly voltage element |
| 32ba | concentric mobile unit phase contact element |
| 32bj | concentric mobile unit phase wire |
| 32bx | concentric mobile unit phase magnet first magnetic pole |
| 32by | concentric mobile unit phase magnet second magnetic pole |
| 32c | 1-D strip stationary unit ground assembly shaft |
| 32ca | concentric mobile unit ground contact element |
| 32cj | concentric mobile unit ground wire |
| 32cx | concentric mobile unit ground magnet first magnetic pole |
| 32cy | concentric mobile unit ground magnet second magnetic pole |
| 32ea | concentric mobile unit zero magnet |
| 32eb | concentric mobile unit phase magnet |
| 32ec | concentric mobile unit ground magnet |
| 32f | 1-D strip stationary unit ground assembly magnet spring |
| 32g | 1-D strip stationary unit ground assembly voltage element spring |
| 32h | 1-D strip stationary unit ground assembly housing |
| 32i | 1-D strip stationary unit ground assembly housing end disk |
| 32j | 1-D strip stationary unit ground assembly voltage element wire |
| 32l | 1-D strip stationary unit ground assembly symmetry axis |
| 32p | electromagnet core |
| 32q | electromagnet coil |
| 32r | electromagnet coil first pin |
| 32s | electromagnet coil second pin |
| 33 | 1-D strip stationary unit floating pad assembly |
| 33a | 1-D strip stationary unit floating pad assembly contact element |
| 33b | 1-D strip stationary unit floating pad assembly voltage element |
| 33c | 1-D strip stationary unit floating pad assembly shaft |
| 33e | 1-D strip stationary unit floating pad assembly magnet |
| 33f | 1-D strip stationary unit floating pad assembly magnet spring |
| 33g | 1-D strip stationary unit floating pad assembly voltage element spring |
| 33h | 1-D strip stationary unit floating pad assembly housing |
| 33i | 1-D strip stationary unit floating pad assembly housing end disk |
| 33j | movable phase element wire |
| 33k | fixed phase element |
| 33l | 1-D strip stationary unit floating pad assembly symmetry axis |
| 33t | fixed phase element wire |
| 34 | cantilever version of a magnetic double switch |
| 34a | cantilever version of a magnetic double switch assembly contact element |
| 34e | cantilever version of a magnetic double switch assembly magnet |
| 34h | cantilever version of a magnetic double switch assembly housing |
| 34jg | cantilever version of a magnetic double switch assembly voltage element wire and assembly voltage element spring |
| 34p | cantilever version of a magnetic double switch assembly coil |
| 34t | cantilever version of a magnetic double switch assembly coil wire |
| 34u | cantilever version of a magnetic double switch assembly fixed wire |
| 34v | cantilever version of a magnetic double switch assembly movable wire |
| 34w | cantilever version of a magnetic double switch assembly isolator |
| 35 | cantilever version of electro-magnetic double switch assembly |
| 35a | cantilever version of electro-magnetic double switch assembly contact element |
| 35e | cantilever version of electro-magnetic double switch assembly electromagnet |

-continued

| | |
|---|---|
| 35h | cantilever version of electro-magnetic double switch assembly housing |
| 35jg | cantilever version of electro-magnetic double switch assembly voltage element wire and assembly voltage element spring |
| 35p | cantilever version of electro-magnetic double switch assembly coil |
| 35t | cantilever version of electro-magnetic double switch assembly coil wire |
| 35u | cantilever version of electro-magnetic double switch assembly fixed wire |
| 35v | cantilever version of electro-magnetic double switch assembly movable wire |
| 35w | cantilever version of electro-magnetic double switch assembly isolator |
| 36 | cantilever version floating pad element with electromagnet |
| 36a | cantilever version floating pad element contact element |
| 36e | cantilever version floating pad element electromagnet |
| 36h | cantilever version floating pad element housing |
| 36jg | cantilever version floating pad element voltage element wire and assembly voltage element spring |
| 36kt | cantilever version floating pad element coil wire |
| 36p | cantilever version floating pad element coil |
| 36t | cantilever version floating pad element coil wire |
| 36u | cantilever version floating pad element fixed wire |
| 36v | cantilever version floating pad element movable wire |
| 36w | cantilever version floating pad element isolator |
| 37 | electro-magnetic double switch assembly |
| 37a | electro-magnetic double switch assembly contact element |
| 37b | electro-magnetic double switch assembly voltage element |
| 37c | electro-magnetic double switch assembly shaft |
| 37f | electro-magnetic double switch assembly electromagnet spring |
| 37g | electro-magnetic double switch assembly voltage element spring |
| 37h | electro-magnetic double switch assembly housing |
| 37i | electro-magnetic double switch assembly housing end disk |
| 37j | electro-magnetic double switch assembly movable phase element wire |
| 37k | electro-magnetic double switch assembly DC element |
| 37l | electro-magnetic double switch assembly symmetry axis |
| 37p | electro-magnetic double switch assembly electromagnet core |
| 37q | electro-magnetic double switch assembly electromagnet coil |
| 37r | electro-magnetic double switch assembly electromagnet coil first pin |
| 37s | electro-magnetic double switch assembly electromagnet coil second pin |
| 37t | electro-magnetic double switch assembly DC input wire |
| 37u | electro-magnetic double switch assembly DC output wire |
| 37v | electro-magnetic double switch assembly DC contact element |
| 38 | magnetic double switch assembly |
| 38a | magnetic double switch assembly contact element |
| 38b | magnetic double switch assembly voltage element |
| 38c | magnetic double switch assembly shaft |
| 38f | magnetic double switch assembly electromagnet spring |
| 38g | magnetic double switch assembly voltage element spring |
| 38h | magnetic double switch assembly housing |
| 38i | magnetic double switch assembly housing end disk |
| 38j | magnetic double switch assembly movable phase element wire |
| 38k | magnetic double switch assembly DC element |
| 38l | magnetic double switch assembly symmetry axis |
| 38p | magnetic double switch assembly electro-magnet |
| 38x | magnetic double switch assembly first magnetic pole |
| 38y | magnetic double switch assembly second magnetic pole |
| 38t | magnetic double switch assembly DC input wire |
| 38u | magnetic double switch assembly DC output wire |
| 38v | magnetic double switch assembly DC contact element |
| 41 | electrical circuit |
| 41g | ground source |
| 41p | phase source |
| 41z | zero source |
| 41dc | DC source |
| 60 | non-conductive matrix |
| 71 | mains outlet plug |
| 72 | AC to DC converter |
| 73 | planar stationary unit voltage regulator |
| 74 | mobile unit voltage regulator |
| 76 | portable electronic device's phase plug |
| 101 | planar stationary unit phase, ground, and zero assembly set |
| 101a | planar stationary unit phase, ground, and zero assembly set body |
| 102 | mobile unit phase, ground, and zero assembly set |
| 102a | mobile unit phase, ground, and zero assembly set body |

-continued

| | |
|---|---|
| 103 | apparatus for transferring electrical power |
| 201 | planar stationary unit plus and minus assembly sets grid |
| 202 | mobile unit plus and minus assembly set |
| 202a | planar stationary unit plus and minus assembly sets grid body |
| 203 | apparatus for transferring DC electrical power |
| 301 | 1 -D strip stationary unit |
| 301a | 1-D strip stationary unit body |
| 302 | concentric mobile unit |
| 302a | concentric mobile unit body |
| 303 | apparatus for transferring AC electrical power, with concentric mobile unit |
| 401 | 2-D strip stationary unit |
| 401a | 2-D strip stationary unit body |

Referring now to the drawings, FIG. 1*a* of the prior art illustrates an exploded perspective view of a plug upon which the section plane 1*b*-1*b* is marked, and socket assembly upon which the section plane 1*c*-1*c* is marked, showing the plug disconnected from the socket according to U.S. Pat. No. 3,521,216.

Figure 1B:
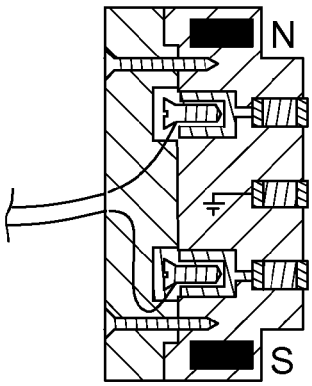
FIG.1b PRIOR ART
FIG. 1*b* is a cross section of the plug taken in the direction of the arrows 1*b*-1*b* of FIG. 1*a*.

FIG. 1*b* is a cross section of the plug taken in the direction of the arrows 1*b*-1*b* of FIG. 1*a*.

Figure 1C:
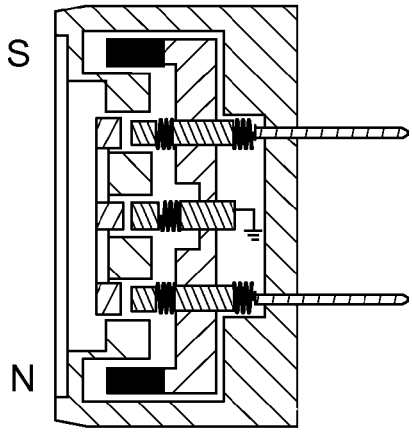
FIG.1c PRIOR ART
FIG. 1*c* is a cross section of the socket taken in the direction of the arrows 1*c*-1*c* of FIG. 1*a*.

FIG. 1*c* is a cross section of the socket taken in the direction of the arrows 1*c*-1*c* of FIG. 1*a*.

Figure 2A:
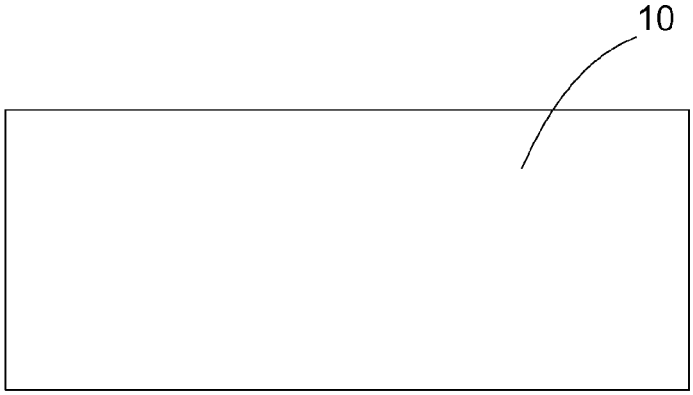
FIG. 2*a* is a side view schematic illustration of an exemplary, illustrative embodiment of a single planar stationary unit phase switch assembly, according to the present invention.

FIG. 2*a* is a side view schematic illustration of an exemplary, illustrative embodiment of a single planar stationary unit phase switch assembly 10, according to the present invention.

Figure 2B:
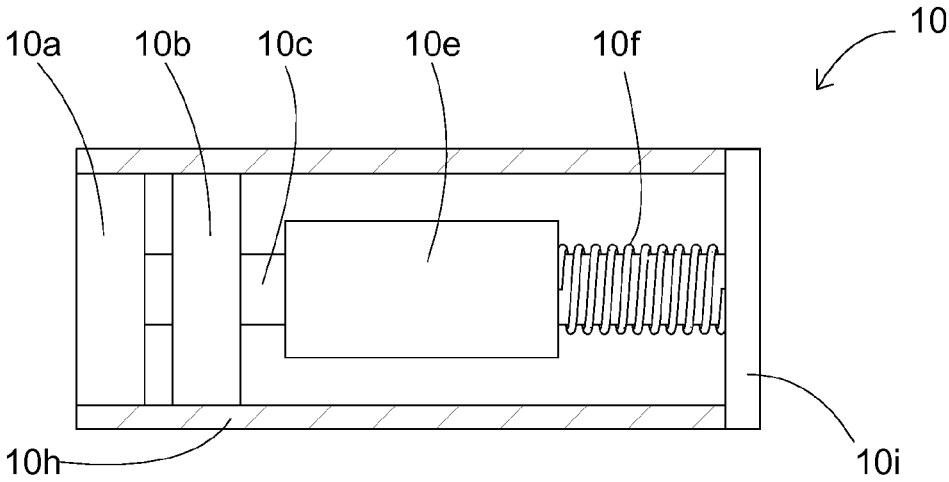
FIG. 2*b* is a partial cut-away side view schematic illustration of an exemplary, illustrative embodiment of a single planar stationary unit phase switch assembly in the planar stationary unit phase, ground, and zero assembly set, according to the present invention.

FIG. 2*b* is a partial cut-away side view schematic illustration of an exemplary, illustrative embodiment of a single planar stationary unit phase switch assembly 10 according to the present invention.

The figure depicts the elements comprising it, and the way they are arranged with regards to each other, while omitting the planar stationary unit phase assembly voltage element spring (10*g*), and the planar stationary unit phase wire (10*j*).

A planar stationary unit phase assembly housing 10*h*, which is electrically non-conductive, including of the remaining elements shown in this figure. A planar stationary unit phase assembly contact element 10*a*, designed to conduct electricity when in contact with a mobile unit phase assembly (20) and is located at one outer edge of the planar stationary unit phase switch assembly 10, a planar stationary unit phase switch assembly shaft 10*c*, which is electrically non-conductive, is located in the middle of the planar stationary unit phase assembly housing 10*h*, on which other elements may travel over, such as a planar stationary unit phase assembly voltage element 10*b*, receiving an electrical voltage by means of a planar stationary unit phase wire (10*j*), which was omitted from said figure, and a planar stationary unit phase assembly magnet 10*e*, attached to a planar stationary unit phase assembly magnet spring 10*f*. The phase element in the planar stationary unit phase switch assembly 10 is sealed at the opposite end of the planar stationary unit phase assembly contact element 10*a* by a planar stationary unit phase assembly housing end disk 10*i*. The planar stationary unit phase switch assembly 10 can have a planar stationary unit phase switch assembly symmetry axis 10*l*.

Figure 2C:
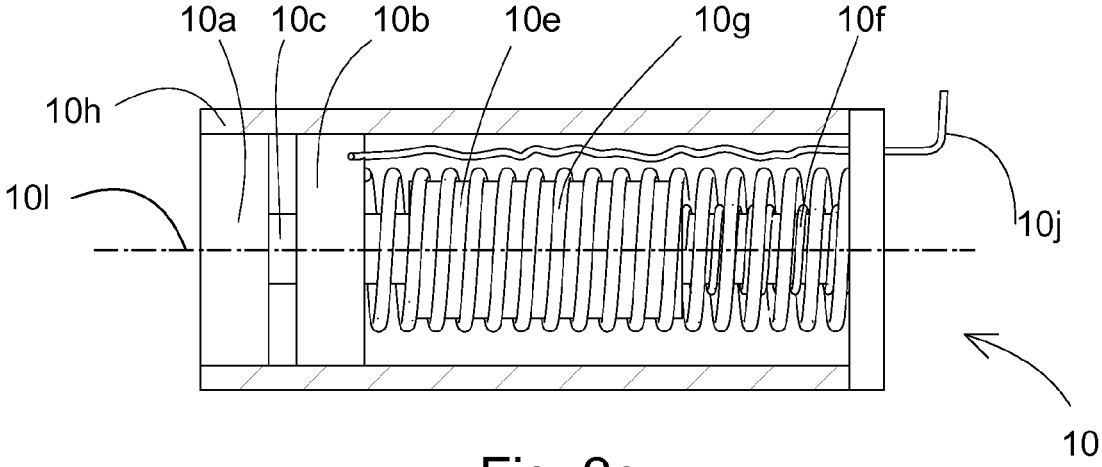
FIG. 2*c* is a partial cut-away side view schematic illustration of an exemplary, illustrative embodiment of a single planar stationary unit phase switch assembly according to the present invention.

FIG. 2*c* is a partial cut-away side view schematic illustration of an exemplary, illustrative embodiment of a single planar stationary unit phase switch assembly 10 according to the present invention.

This figure depicts the planar stationary unit phase wire 10*j*. In normal operation the planar stationary unit phase assembly voltage element spring 10*g* ensures that there is a gap between the planar stationary unit phase assembly contact element 10*a*, and the planar stationary unit phase assembly voltage element 10*b*, such that there is no electrical contact between them. Should a suitable (and strong enough) magnetic force be applied to the planar stationary unit phase assembly magnet 10*e*, it will overcome the strength of the planar stationary unit phase assembly magnet spring 10*f*, and the planar stationary unit phase assembly voltage element spring 10*g*, creating a physical contact which enables an electrical current to flow between the planar stationary unit phase assembly contact element 10*a*, and the planar stationary unit phase assembly voltage element 10*b*.

Planar stationary unit phase wire 10*j* can also be omitted, and a planar stationary unit phase assembly voltage element spring 10*g* can be used as an electrical conductor in its place.

Figure 2D:
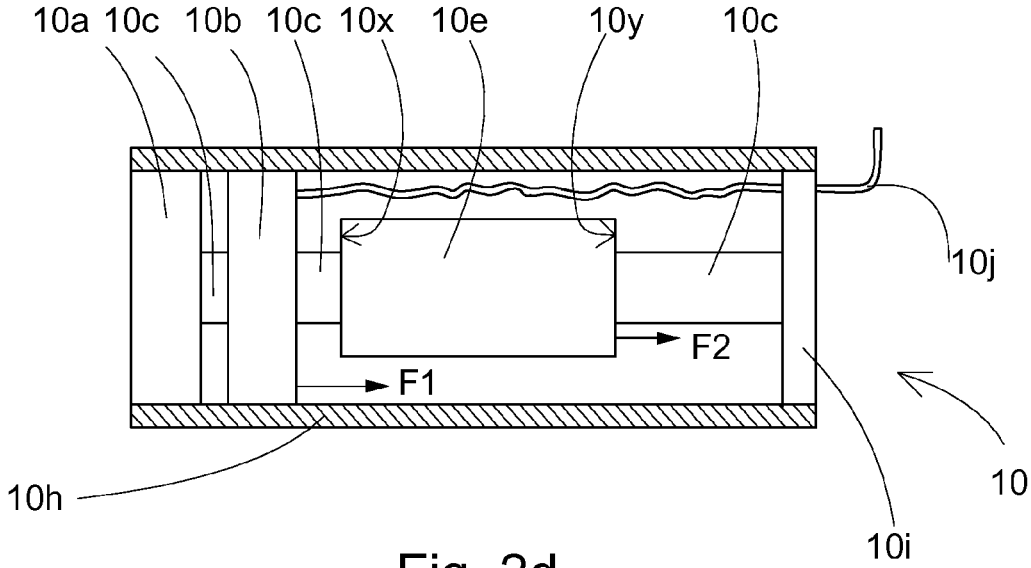
FIG. 2*d* is a partial cut-away side view schematic illustration of an exemplary, illustrative embodiment of a single planar stationary unit phase switch assembly, according to the present invention.

FIG. 2*d* is a partial cut-away side view schematic illustration of an exemplary, illustrative embodiment of a single planar stationary unit phase switch assembly 10, according to the present invention. The illustration shows force F1 which applies to the planar stationary unit phase assembly voltage element 10*b*, while so long as it is not overphased, there will be no contact between the planar stationary unit phase assembly voltage element 10*b* and planar stationary unit phase assembly contact element 10*a*, and force F2 which applies to the planar stationary unit phase assembly magnet 10*e*, while only applying a stronger force in the opposite direction will enable movement of the planar stationary unit phase assembly magnet 10*e* in the direction of the planar stationary unit phase assembly voltage element 10*b*.

Figure 3A:
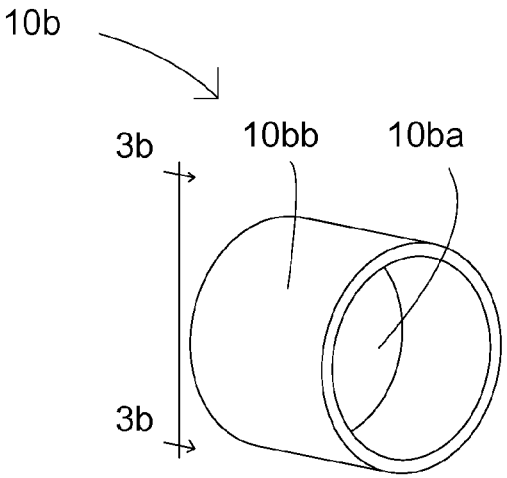
FIG. 3*a* is a schematic perspective view schematic illustration of an exemplary, illustrative embodiment of the planar stationary unit phase assembly voltage element, according to the present invention, upon which the section plane 3*b*-3*b* is marked.

FIG. 3*a* is a schematic perspective view schematic illustration of an exemplary, illustrative embodiment of the planar stationary unit phase assembly voltage element 10*b*, according to the present invention, upon which the section plane 3*b*-3*b* is marked.

This figure depicts a possible structure of the planar stationary unit phase assembly voltage element 10*b* assembly, which is shaped as a cylinder comprising of a planar stationary unit phase assembly voltage element base 10*ba*, and a planar stationary unit phase assembly voltage element wall 10*bb*, allowing for the best possible movement within the planar stationary unit phase assembly housing 10*h*.

Figure 3B:
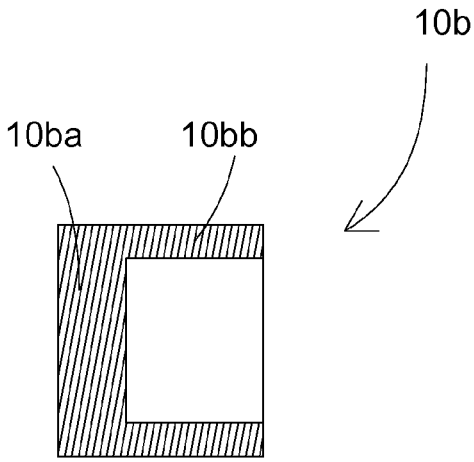
FIG. 3*b* is a schematic cross sectional side view 3*b*-3*b* schematic illustration of an exemplary, illustrative embodiment of the planar stationary unit phase assembly voltage element, according to the present invention.

FIG. 3*b* is a schematic cross sectional side view 3*b*-3*b* schematic illustration of an exemplary, illustrative embodiment of the planar stationary unit phase assembly voltage element 10*b* according to the present invention.

Figure 4A:
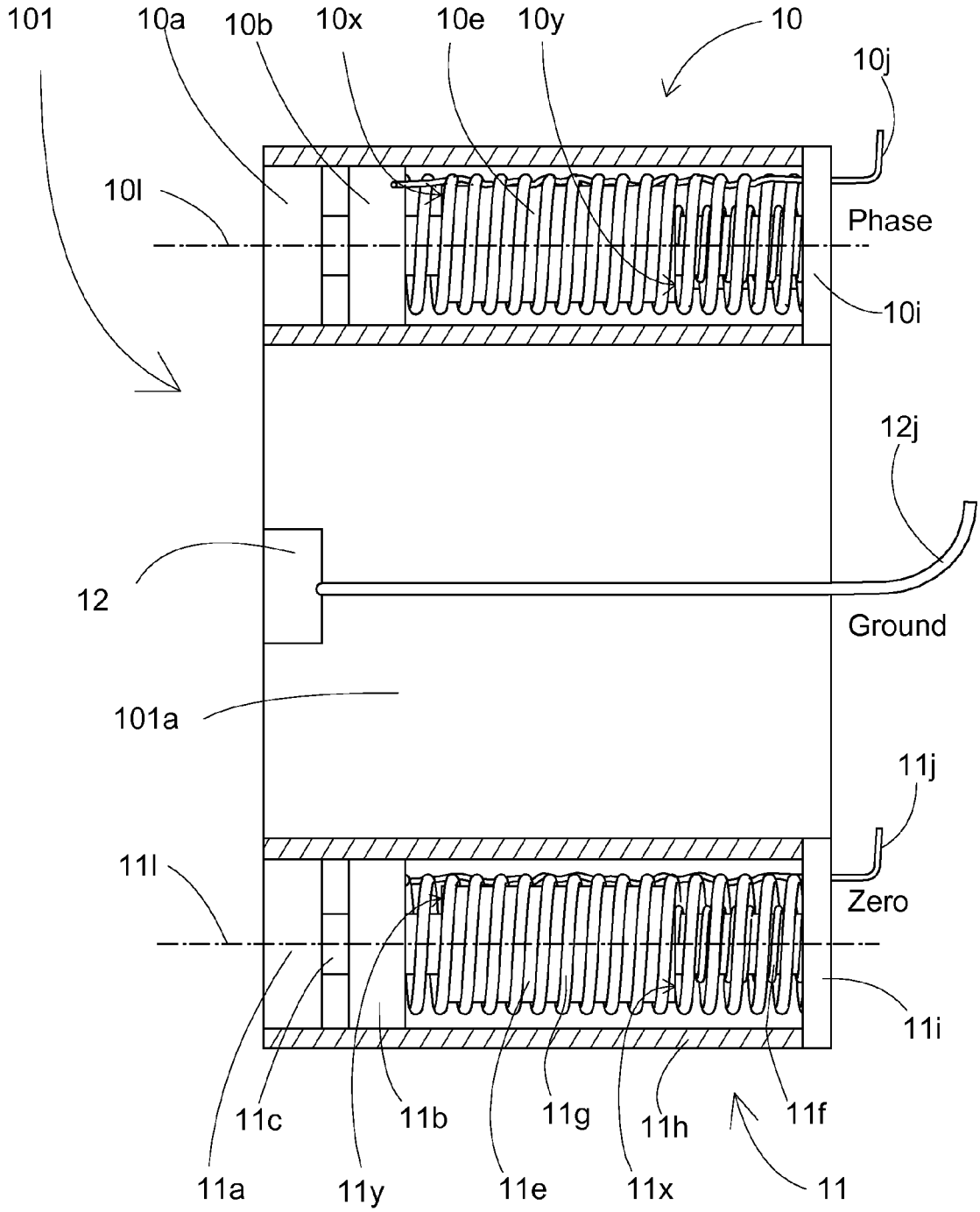
FIG. 4*a* is a partial cut-away view schematic illustration of an exemplary, illustrative embodiment of planar stationary unit phase, ground, and zero assembly set, according to the present invention.

FIG. 4*a* is a partial cut-away side view schematic illustration of an exemplary, illustrative embodiment of planar stationary unit phase, ground, and zero assembly set 101 according to the present invention, including of a planar stationary unit phase, ground, and zero assembly set body 101*a*, in which the planar stationary unit phase switch assembly 10, and a planar stationary unit zero assembly 11, which is connected to a planar stationary unit zero wire 11*j* located in a single plane, as seen in the figure, and each at the same distance from a planar stationary unit ground element 12, which is connected to a planar stationary unit ground element wire 12*j*.

The planar stationary unit phase switch assembly 10 includes a planar stationary unit phase assembly magnet first magnetic pole 10*x*, (for example, north pole) and a planar stationary unit phase assembly magnet second magnetic pole 10*y*, (for example, south pole) which are in of opposite polarity to the planar stationary unit zero assembly magnet first magnetic pole 11*x*, (for example, north pole) and the planar stationary unit zero assembly magnet second magnetic pole 11*y*, (for example, south pole) of the planar stationary unit zero element 11. The planar stationary unit zero element 11 has planar stationary unit zero assembly 11*c*, planar stationary unit zero assembly voltage element 11*b*, planar stationary unit zero assembly magnet spring 11*f*, planar stationary unit zero assembly voltage element spring 11*g*, planar stationary unit zero assembly housing 11*h*, and planar stationary unit zero assembly housing end disk 11*i*, and can have a planar stationary unit zero assembly symmetry axis 11*l*.

Figure 4B:
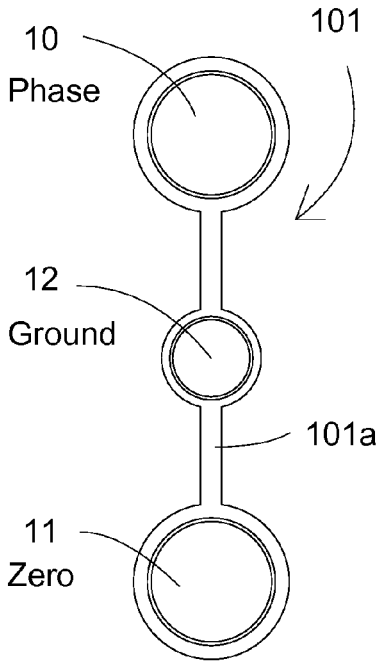
FIG. 4*b* is a front view schematic illustration of an exemplary, illustrative embodiment of planar stationary unit phase, ground, and zero assembly set, according to the present invention.

FIG. 4*b* is a front view schematic illustration of an exemplary, illustrative embodiment of planar stationary unit phase, ground, and zero assembly set, according to the present invention. In the case described in the figure, the planar stationary unit phase switch assembly 10, the planar stationary unit ground element 12, and the planar stationary unit zero assembly 11 cross sections are circular, but other shapes are possible as well.

Figure 5:
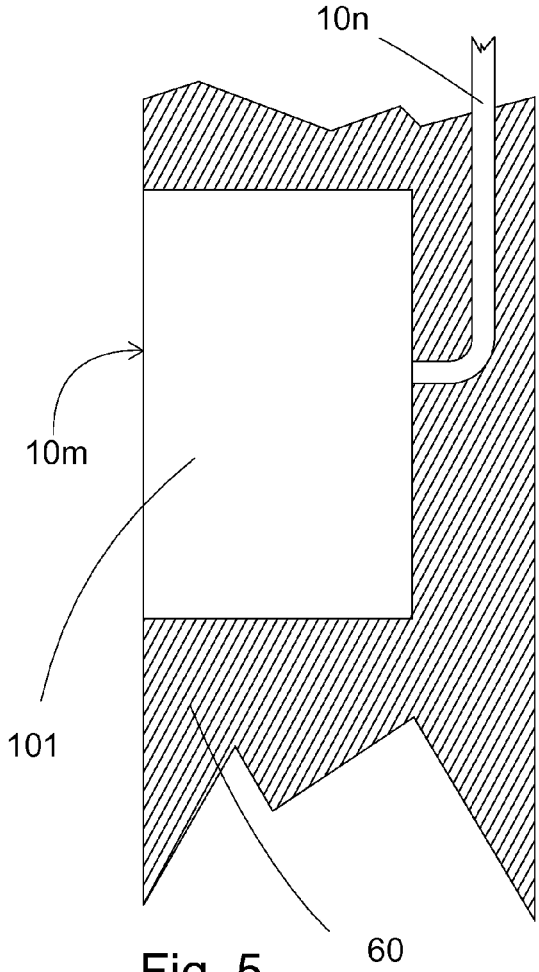
FIG. 5 is a schematic side view schematic illustration of an exemplary, illustrative embodiment of planar stationary unit phase, ground, and zero assembly set, embedded within the non-conductive matrix, according to the present invention.

FIG. 5 is a schematic side view schematic illustration of an exemplary, illustrative embodiment of planar stationary unit phase, ground, and zero assembly set 101, embedded within the non-conductive matrix 60, such as a building wall, according to the present invention. Pipe 10*n* may serve for securing and protecting the electrical wires connected to the main phase grid to the planar stationary unit phase, ground, and zero assembly set 101. The planar stationary unit phase, ground, and zero assembly set 101 have planar surface 10*m*.

Figure 6A:
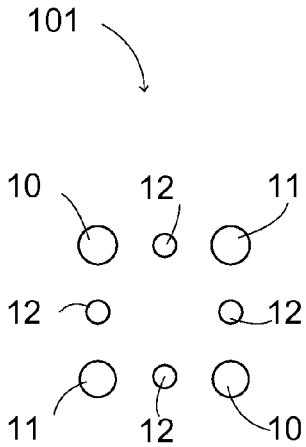
FIG. 6*a* is a schematic top view schematic illustration of an exemplary, illustrative embodiment of the planar stationary unit phase, ground, and zero assembly set, including several planar stationary unit phase switch assemblies, planar stationary unit ground elements, and planar stationary unit zero assemblies, arranged in a matrix as described in the figure, with round cross section are used, according to the present invention.

FIG. 6*a* is a schematic top view schematic illustration of an exemplary, illustrative embodiment of the planar stationary unit phase, ground, and zero assembly set 101, including several planar stationary unit phase switch assemblies 10, several planar stationary unit ground elements 12, and several planar stationary unit zero assemblies 11, arranged in a matrix as described in the figure, with round cross section are used, according to the present invention.

Figure 6B:
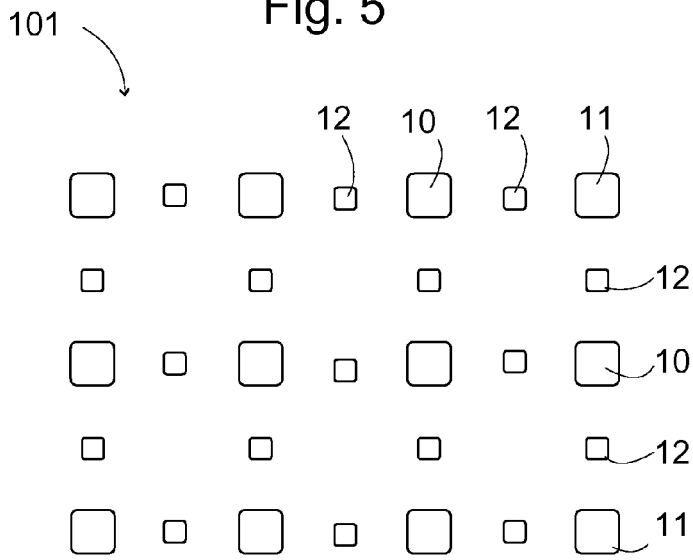
FIG. 6*b* is a schematic top view schematic illustration of an exemplary, illustrative embodiment of the planar stationary unit phase, ground, and zero assembly set, where planar stationary unit phase switch assembly, planar stationary unit ground element, and planar stationary unit zero assembly, with square cross section are used, according to the present invention.

FIG. 6*b* is a schematic top view schematic illustration of an exemplary, illustrative embodiment of the planar stationary unit phase, ground, and zero assembly set 101, including several planar stationary unit phase switch assemblies 10, several planar stationary unit ground elements 12, and several planar stationary unit zero assemblies 11, with square cross section are used, arranged in a matrix as described in the figure, according to the present invention.

Figure 7A:
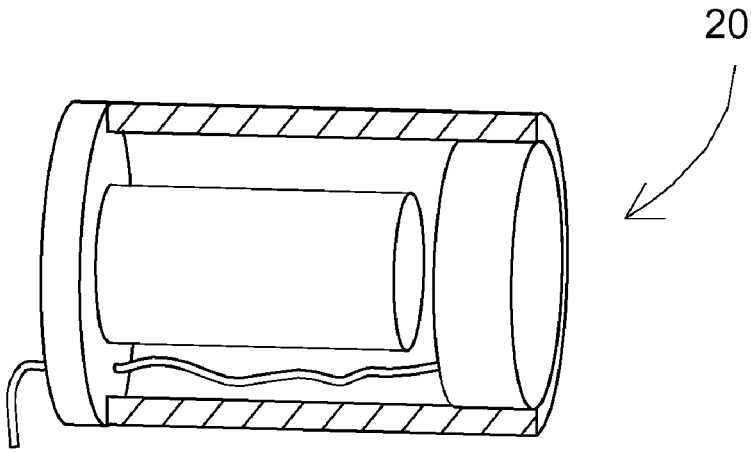
FIG. 7*a* is a partial cut-away isometric view schematic illustration of an exemplary, illustrative embodiment of a mobile unit phase assembly according to the present invention.

FIG. 7*a* is a partial cut-away isometric view schematic illustration of an exemplary, illustrative embodiment of a mobile unit phase assembly 20 according to the present invention.

Figure 7B:
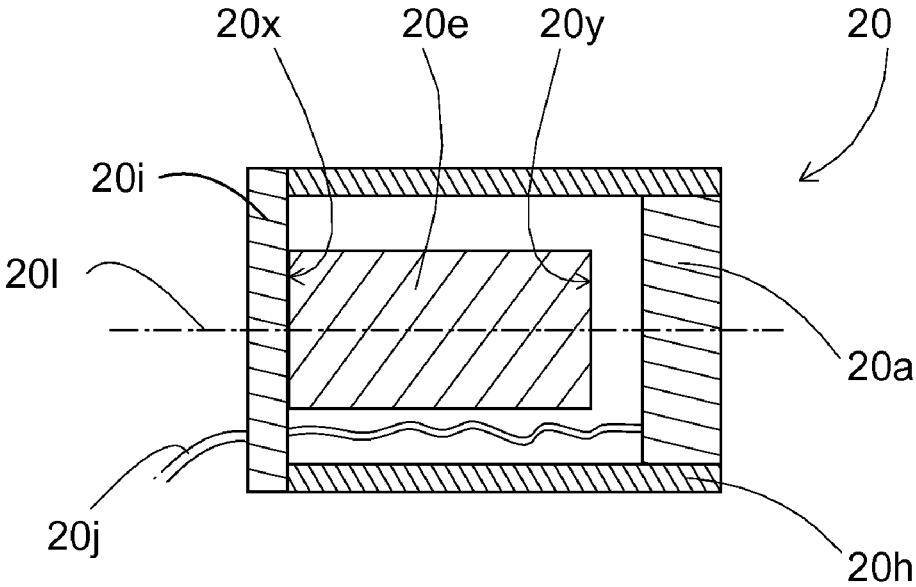
FIG. 7*b* is a schematic cross sectional side view schematic illustration of an exemplary, illustrative embodiment of a mobile unit phase assembly, according to the present invention.

FIG. 7*b* is a partial cut-away side view schematic illustration of an exemplary, illustrative embodiment of a mobile unit phase assembly 20 according to the present invention. The mobile unit phase assembly 20 can have a mobile unit phase assembly symmetry axis 20*l*.

A mobile unit phase assembly housing 20*h* including inside of it, a mobile unit phase assembly magnet 20*e* which has a mobile unit phase assembly magnet first magnetic pole 20*x*, and a mobile unit phase assembly magnet second magnetic pole 20*y* and is sealed in the back by a mobile unit phase assembly housing end disk 20*i* and in the front by a mobile unit assembly phase assembly contact element 20*a*, used to receive an electrical current from a planar stationary unit phase assembly contact element (10*a*), to which a mobile unit phase assembly phase wire 20*j* is connected.

Figure 7C:
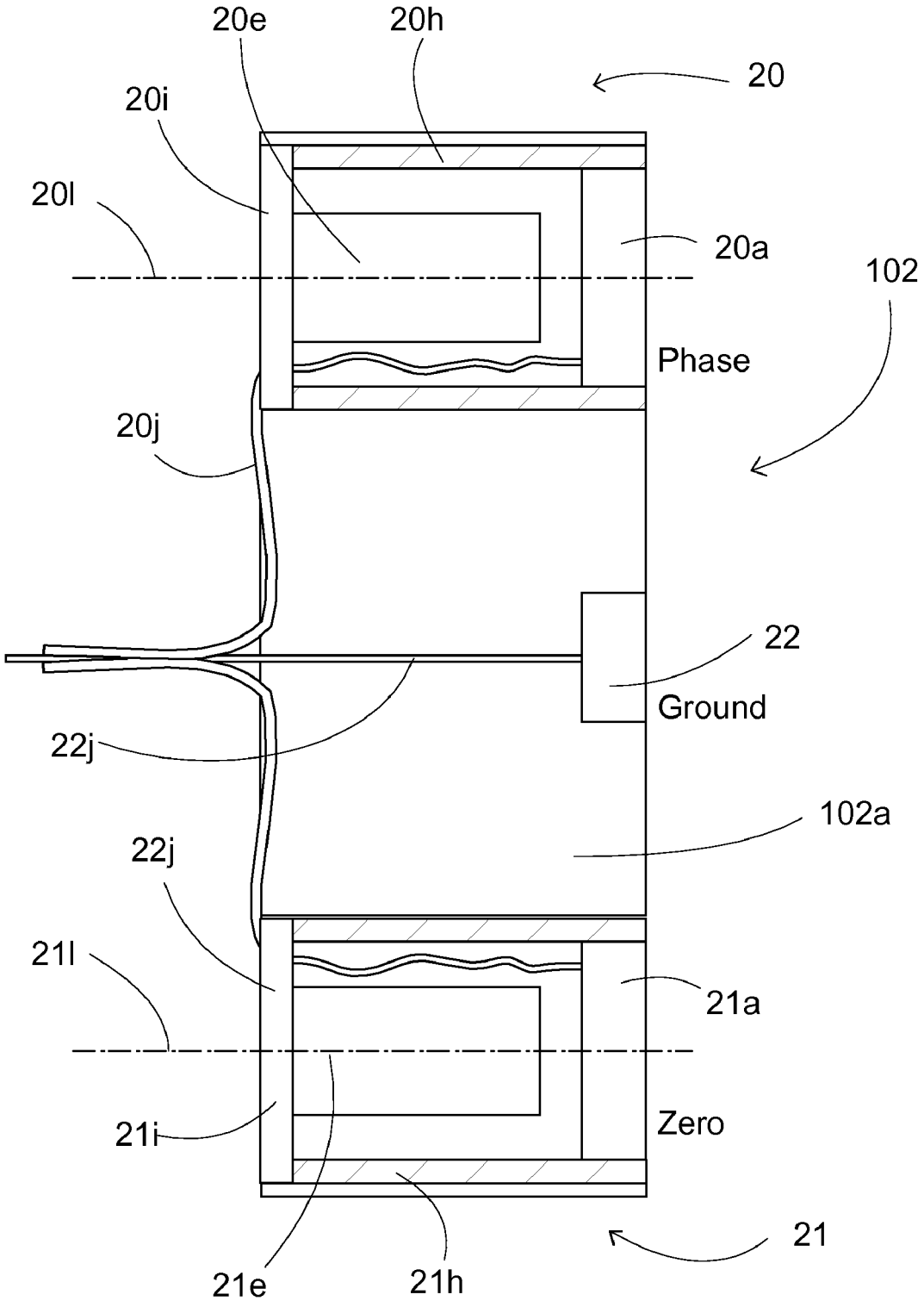
FIG. 7*c* is a partial cut-away side view schematic illustration of an exemplary, illustrative embodiment of a mobile unit phase, ground, and zero assembly set, according to the present invention.

FIG. 7*c* is a partial cut-away side view schematic illustration of an exemplary, illustrative embodiment of a mobile unit phase, ground, and zero assembly set 102 according to the present invention. Mobile unit phase, ground, and zero assembly set 102 including the mobile unit phase assembly 20, the mobile unit zero assembly 21, and the mobile unit ground element 22, connected to mobile unit ground element wire 22*j*. The mobile unit zero assembly 21 has a mobile unit zero assembly contact element 21*a*, a mobile unit zero assembly magnet 21*e*, a mobile unit zero assembly housing 21*h*, a mobile unit zero assembly housing end disk 21*i*, and a mobile unit zero assembly phase wire 21*j*. The mobile unit zero assembly 21 can have mobile unit zero assembly symmetry axis 21*l*.

Figure 8:
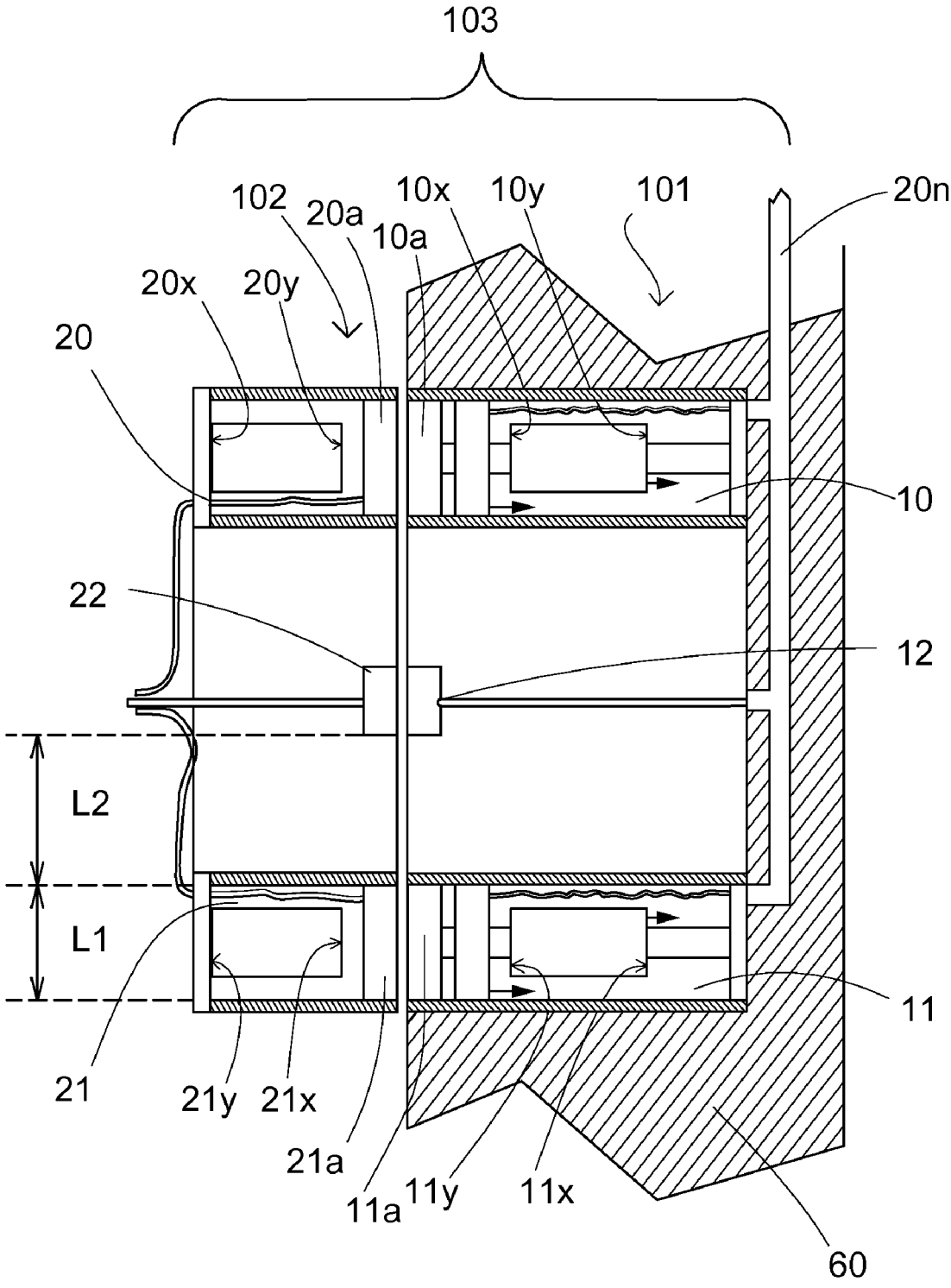
FIG. 8 is a partial cut-away view schematic illustration of an exemplary, illustrative embodiment of an apparatus for transferring electrical phase, according to the present invention.

FIG. 8 is a partial cut-away side view schematic illustration of an exemplary, illustrative embodiment of an apparatus for transferring electrical power 103, according to the present invention. The figure shows the measure L1 representing the width of planar stationary unit zero assembly 11, and L2, representing the distance between it and the planar stationary unit ground element 12.

Figure 9A:
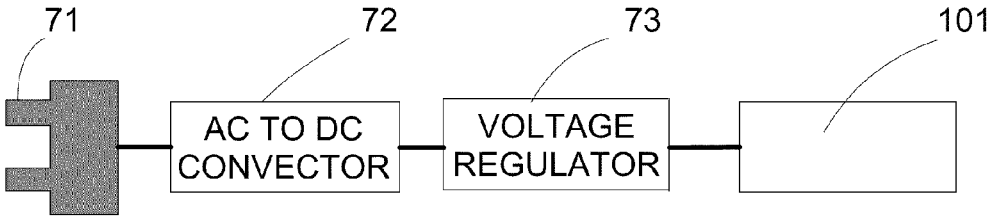
FIG. 9*a* is a schematic diagram of a means of supplying DC voltage to the planar stationary unit phase, ground, and zero assembly set, according to the present invention.

FIG. 9*a* is a schematic diagram of a means of supplying DC voltage to the planar stationary unit phase, ground, and zero assembly set (101), according to the present invention.

Figure 9B:
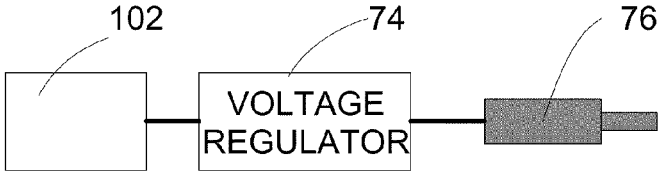
FIG. 9*b* is a schematic diagram describing possible arrangement of supplying the DC voltage from a mobile unit phase, ground, and zero assembly set, to a receiving portable electronic device's phase plug, according to the present invention.

FIG. 9*b* is a schematic diagram describing a possible arrangement of supplying the DC voltage from a mobile unit phase, ground, and zero assembly set 102, to a receiving portable electronic device's phase plug 76.

Figure 10:
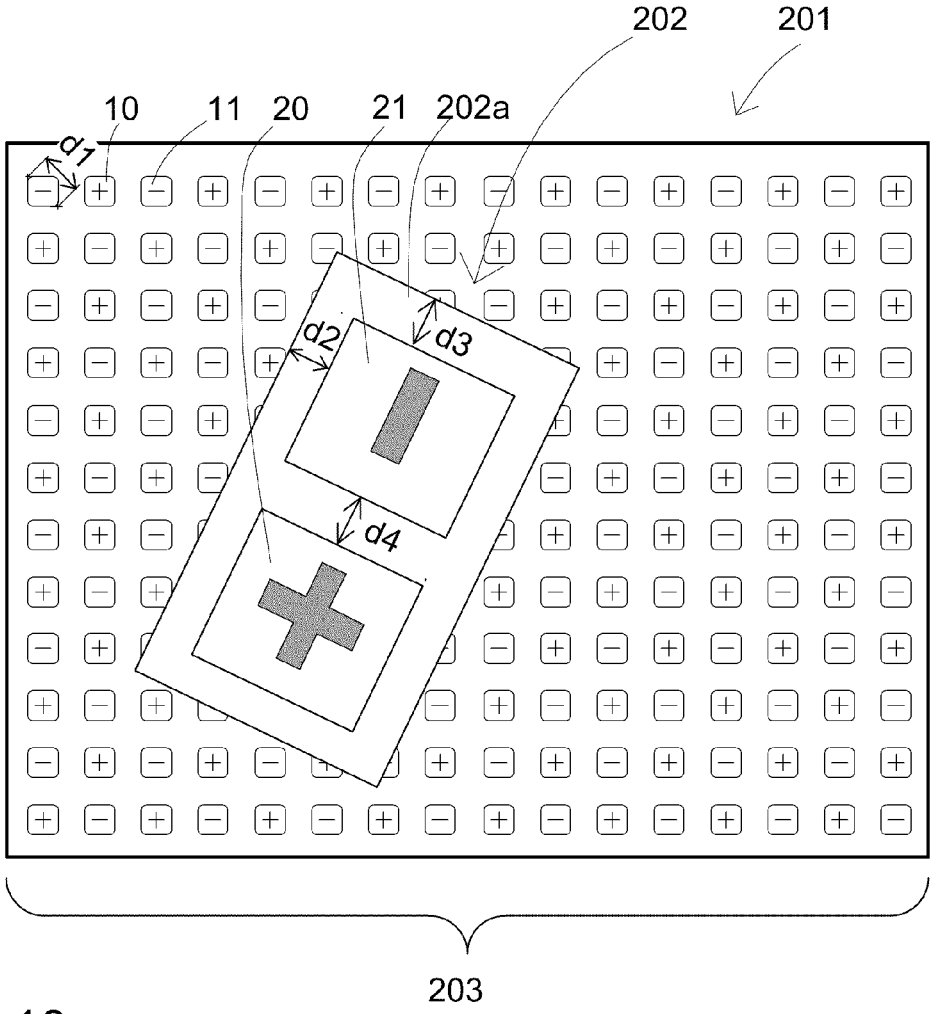
FIG. 10 is a schematic top view schematic illustration of an exemplary, illustrative embodiment of an apparatus for transferring DC electrical power, according to the present invention, also depicts several dimensions crucial to the safety of the apparatus for transferring electrical power, according to the present invention.

FIG. 10 is a schematic top view schematic illustration of an exemplary, illustrative embodiment of an apparatus for transferring DC electrical power 203, according to the present invention.

The apparatus for transferring DC electrical power 203 includes a planar stationary unit plus and minus assembly sets grid 201, and a mobile unit plus and minus assembly set 202, also depicts several dimensions crucial to the safety of the apparatus for transferring electrical power, according to the present invention.

Planar stationary unit phase switch assemblies 10 and mobile unit phase assembly 20 serve in this instance for conducting a straight positive current, while planar stationary unit zero assemblies 11 and mobile unit zero assembly 21 serve in this instance for conducting a straight negative current and are set in a non-conductive planar stationary unit plus and minus assembly sets grid body 202*a*.

d1 is the largest length dimension of the planar stationary unit zero assembly 11 cross section area.

d2, d3 is the dimensions of the planar stationary unit plus and minus assembly sets grid body 202*a* around the mobile unit phase assembly 20, and the mobile unit zero assembly 21.

d4 is the distance between the mobile unit phase assembly 20 and the mobile unit zero assembly 21.

In order to prevent accidental contact between a live plate in the planar stationary plus and minus assembly sets grid 201 and a person there must be sufficient insulation around the mobile unit plus and minus assembly set 202, and the mobile unit zero assembly 21.

This is achieved by making the non-conductive planar stationary unit plus and minus assembly sets grid body 202*a* large enough to overlap any live phase plates in the planar stationary unit plus and minus assembly sets grid 201. Therefore, the dimensions d2 and d3 must be larger then d1.

In order to prevent any shorts between the mobile unit phase assembly 20 plate and the mobile unit zero assembly 21 plate, the distance between them must be large enough so that no live power plate in the planar stationary unit plus and minus assembly sets grid 201 may touch both plates in the mobile unit plus and minus assembly set 202 simultaneously.

This is achieved by making the distance between the mobile unit phase assembly 20 plate and the mobile unit zero assembly 21 plate larger than d1. This description refers to the case where all the dimensions of the planar stationary unit phase switch assemblies 10, and the planar stationary unit zero assemblies 11 of the planar stationary unit plus and minus assembly sets grid 201, are identical to each other.

The mobile unit plus and minus assembly set 202 depict a case where the mobile unit phase assembly 20, is greatly larger then a single planar stationary unit plus and minus assembly sets grid 201.

In such a case, it is not possible to use the planar stationary unit ground element 12 and the mobile unit ground element 22, as they would cause shorts between one of the contact elements in the mobile unit plus and minus assembly set 202 contact elements in the planar stationary unit plus and minus assembly sets grid 201.

Such a large mobile unit plus and minus assembly set 202 (compared to a single planar stationary unit plus and minus assembly sets grid 201) ensures that there will always be at least one planar stationary unit phase switch assembly 10 under the mobile unit phase assembly 20, and at least one planar stationary unit zero assembly 11 under the mobile unit zero assembly 21, with no regards to the orientation of the mobile unit plus and minus assembly set 202 when placed on the planar stationary unit plus and minus assembly sets grid 201.

Figure 11A:
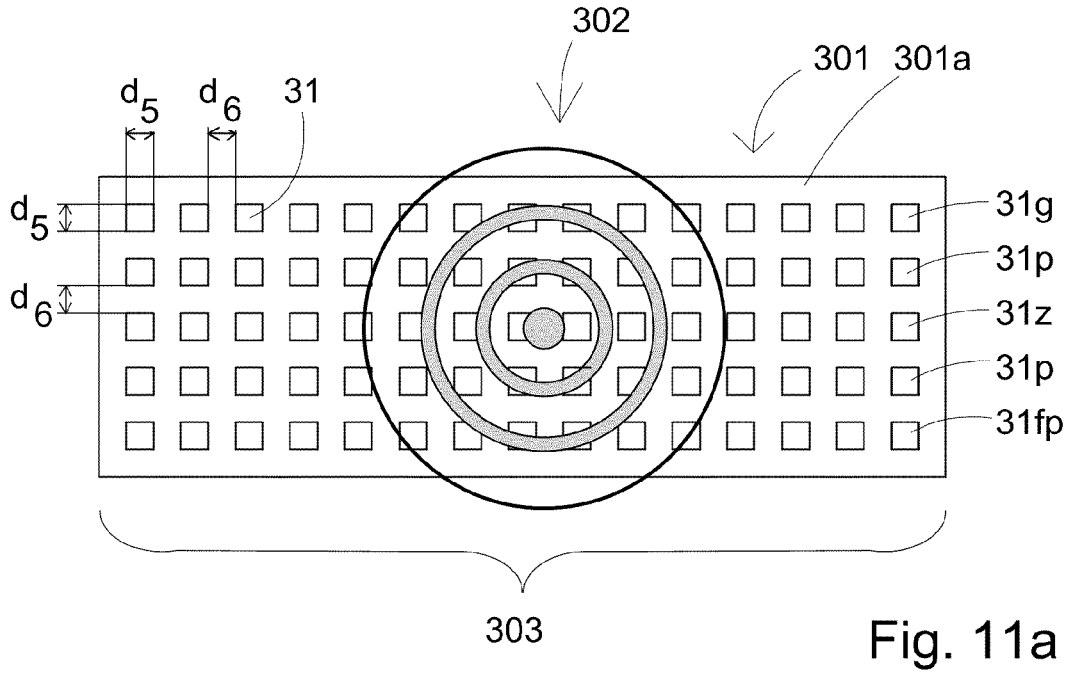
FIG. 11*a* is a schematic top view schematic illustration of an exemplary, illustrative embodiment of an apparatus for transferring AC electrical power having a 1-D strip stationary unit according to the present invention.

FIG. 11*a* is a schematic top view schematic illustration of an exemplary, illustrative embodiment of an apparatus for transferring AC electrical power, with concentric mobile unit 303 having a 1-D strip stationary unit 301 according to the present invention.

The apparatus for transferring AC electrical power, with concentric mobile unit 303 includes a 1-D strip stationary unit 301 and a concentric mobile unit 302.

The 1-D strip stationary unit 301 includes a 1-D strip stationary unit body 301*a* with a flat surface area, in which a component array is set, each component having 1-D apparatus for transferring electrical power element 31, such as ground element 31*g*, phase element 31*p*, zero element 31*z*, and floating pad 31*fg*, also having a flat surface area, and all on the same plane as the flat surface area of the 1-D strip stationary unit body 301*a*.

Figure 11B:
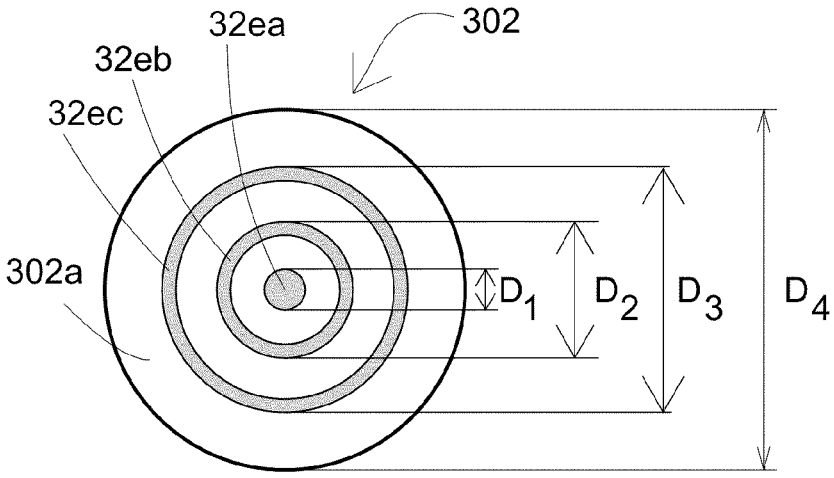
FIG. 11*b* is a schematic top view schematic illustration of an exemplary, illustrative embodiment of a concentric mobile unit, according to the present invention.
Figure 11C:
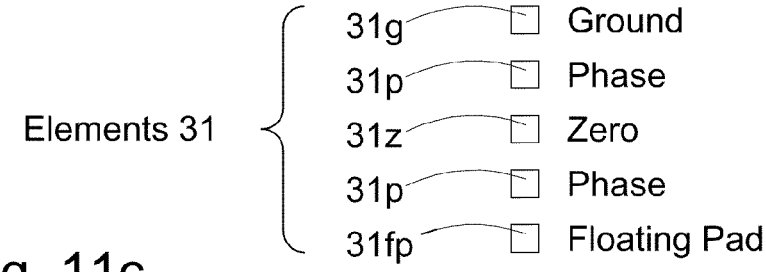
FIG. 11*c* is a schematic top view schematic illustration of an exemplary, illustrative embodiment of a single column of assemblies of the 1-D strip stationary unit according to the present invention.

The component array includes side-by-side columns, each of which is composed of five components, as will be shown in FIG. 11*c*.

The present illustration does not show the electrical contacts and wires of the 1-D strip stationary unit 301 and concentric mobile unit 302.

The dimension of the gap between adjacent columns and adjacent rows is marked in the present illustration as $d_6$, while the height and width dimensions of each 1-D apparatus for transferring electrical power element 31 are marked as $d_5$.

FIG. 11*b* is a schematic top view schematic illustration of an exemplary, illustrative embodiment of a concentric mobile unit 302, according to the present invention.

The concentric mobile unit 302 includes a concentric mobile unit body 302*a* whose cross section has shape and dimensions which can contain at least a circle with a diameter $D_4$, and which contains a concentric mobile unit ground magnet 32*ec*, which has an external diameter $D_3$, and a concentric mobile unit phase magnet 32*eb*, which has an external diameter $D_2$, both of which contain concentric mobile unit zero magnet 32*ea*, which has an external diameter $D_1$. One good optional dimension of $D_1$ is approximately 1.5 times the dimension of the gap $d_6$, and the magnets are disposed concentrically.

All of these diameters conform to the dimensions of $d_5$ and $d_6$.

Dimension $D_4$ is especially significant for ensuring that no 'live' 1-D apparatus for transferring electrical power element 31 of 1-D strip stationary unit 301 is exposed to human contact. Note that it is also possible to use a non-circular section shape can be used for the three magnetic cylinders described above.

FIG. 11*c* is a schematic top view schematic illustration of an exemplary, illustrative embodiment of a single column of assemblies of the 1-D strip stationary unit (301), according to the present invention. At the top of the column is a ground element 31*g*, which can be identical in structure to the planar stationary unit phase assembly contact element (10*a*) of the planar stationary unit phase switch assembly (10), however in this instance it serves for connecting to the DC ground. Following, is a phase element 31*p*, an element of a 1-D strip stationary unit ground assembly 32, as described in FIG. 13, which serves in this instance for connecting to the AC phase. Following, is a zero element 31*z* which is an element of a 1-D strip stationary unit ground assembly 32, and can be identical in structure and dimensions to the phase element 31*p*. Following, is an additional phase element 31*p*. At the bottom of the column is a floating pad 31*fg*, which is a component of 1-D strip stationary unit floating pad assembly (33) and whose purpose and structure are described in FIG. 14.

The floating pad 31*fg* is made of a nonconductive material.

The present illustration does not show the electrical contacts and wires of the 1-D strip stationary unit 301 and concentric mobile unit 302.

Figure 12A:
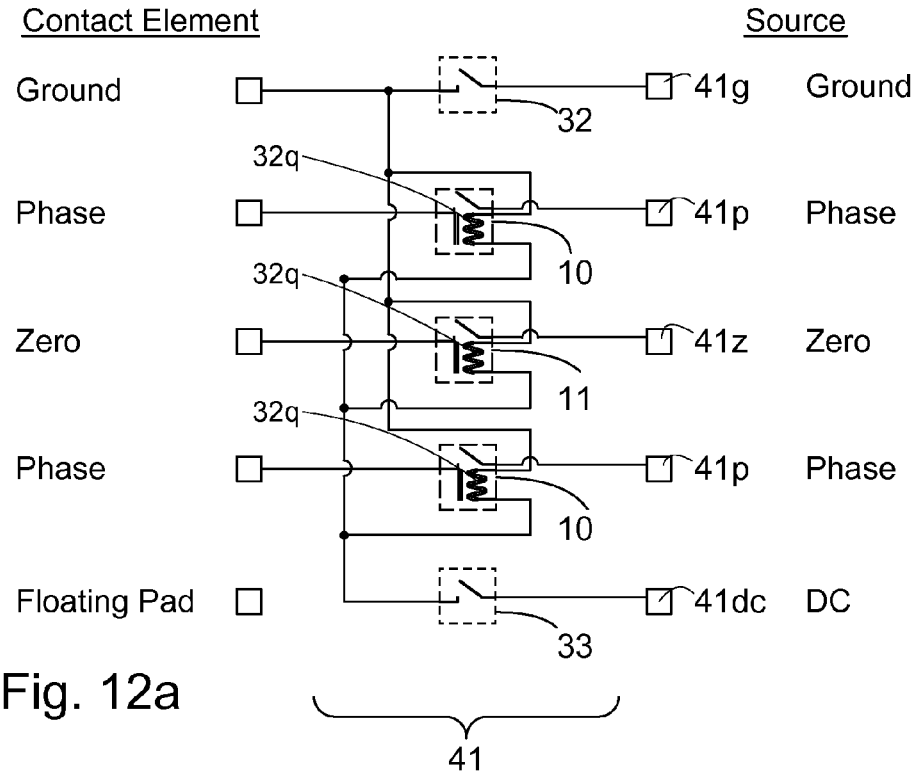
FIG. 12*a* is a schematic electrical diagram of a single column of assemblies of the 1-D strip stationary unit according to the present invention, switched off.

FIG. 12*a* is a schematic electrical diagram of a single column of assemblies of the 1-D strip stationary unit (301), according to the present invention, switched off.

The present schematic illustration shows one 1-D strip stationary unit ground assembly 32, two planar stationary unit phase switch assembly 10, one planar stationary unit zero assembly 11, and one 1-D strip stationary unit floating pad assembly 33, for conducting a straight current, all in open mode.

A parallel electrical connection of the two planar stationary unit phase switch assembly 10, one planar stationary unit zero assembly 11, is superior to serial connection, which is also possible, in order to achieve more uniformly timely and faster closure when their electromagnet coils 32*q* are conducting a straight electrical current.

Figure 12B:
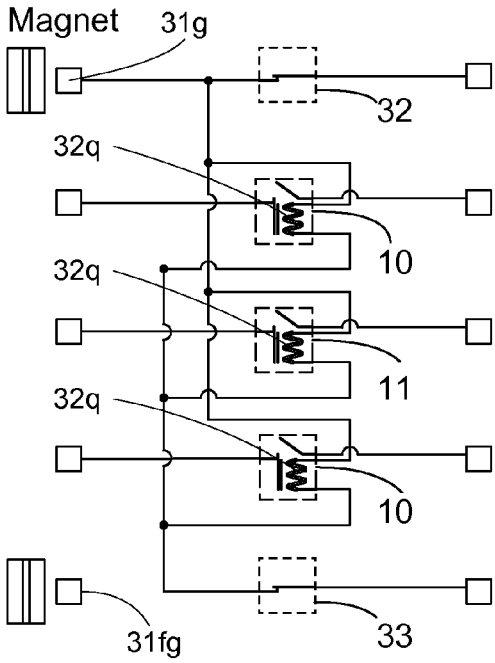
FIG. 12*b* is a schematic electrical diagram of a single column of assemblies of the 1-D strip stationary unit according to the present invention, armed.

FIG. 12*b* is a schematic electrical diagram of a single column of assemblies of the 1-D strip stationary unit (301), according to the present invention, armed.

This state occurs when there are magnets facing ground element 31*g* and the floating pad 31*fg*, which close the two planar stationary unit phase switch assembles 10, and the planar stationary unit zero assembly 11, and result in a straight current, when there is a power source, through the three electro-magnet coils 32*q* and magnetizing of the three electro-magnet cores (32*p*).

Figure 12C:
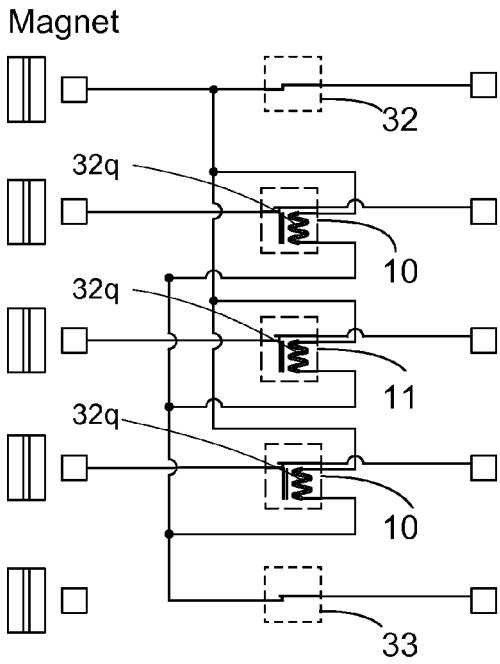

FIG. 12*c* is a schematic electrical diagram of a single column of assemblies of the 1-D strip stationary unit (301), according to the present invention, switched on.

This state occurs when there are magnets facing all five elements of the 1-D apparatus for transferring electrical power element (31), which close the planar stationary unit phase switch assembly 10, the planar stationary unit zero assembly 11, the 1-D strip stationary unit floating pad assembly 33, and the two 1-D strip stationary unit ground assembles 32.

Figure 12D:
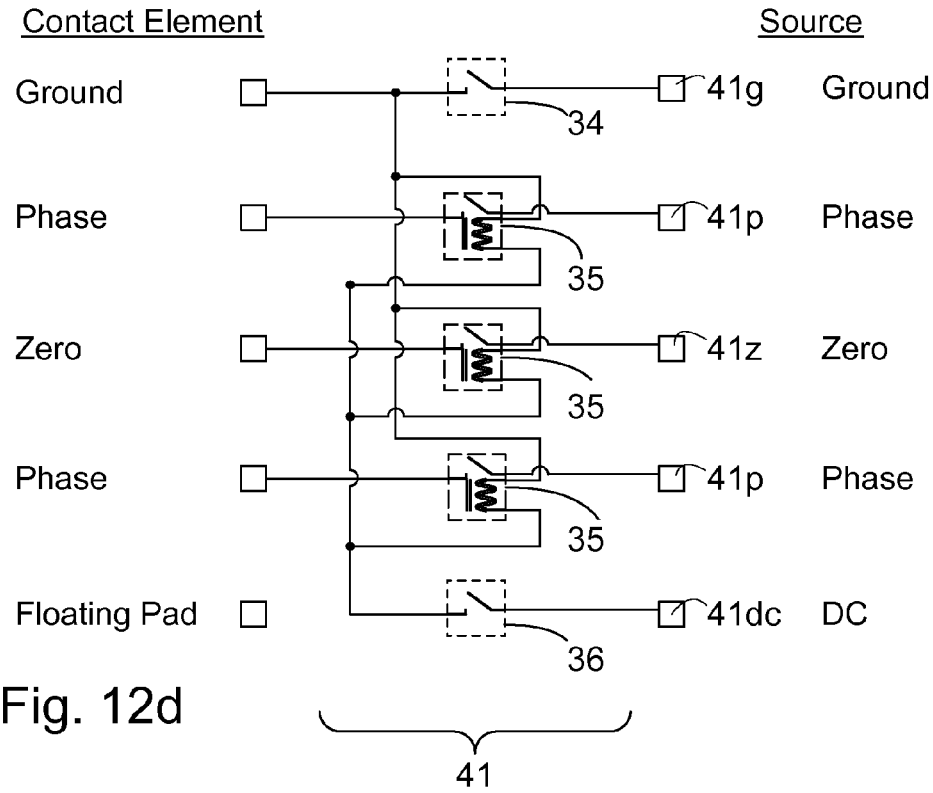
FIG. 12*d* is a schematic electrical diagram of a single column of assemblies of the 1-D strip stationary unit according to the present invention, switched off.

FIG. 12*d* is a schematic electrical diagram of a single column of assemblies of the 1-D strip stationary unit (301), according to the present invention, switched off.

The present schematic illustration shows two cantilever version magnetic switches, a cantilever version ground element with magnet 34, and a cantilever version floating pad element with electro-magnet 36, for conducting a straight current, both in open mode, electrically connected serially to three cantilever version phase/zero element with electromagnet 35, which are also open and parallel connected to each other, and are designated to conduct an alternating current. The parallel electrical connection of the three Cantilever version phase/zero element with electro-magnet 35 is superior to serial connection, which is also possible, in order to achieve more uniformly timely and faster closure when their electro-magnet coils (32*q*) are conducting a straight electrical current.

In the present state, all of the magnetic switches, the cantilever version ground element with magnet 34, and a cantilever version floating pad element with electromagnet 36, and the electro-magnetic switches 35 are, as noted, open.

Figure 12E:
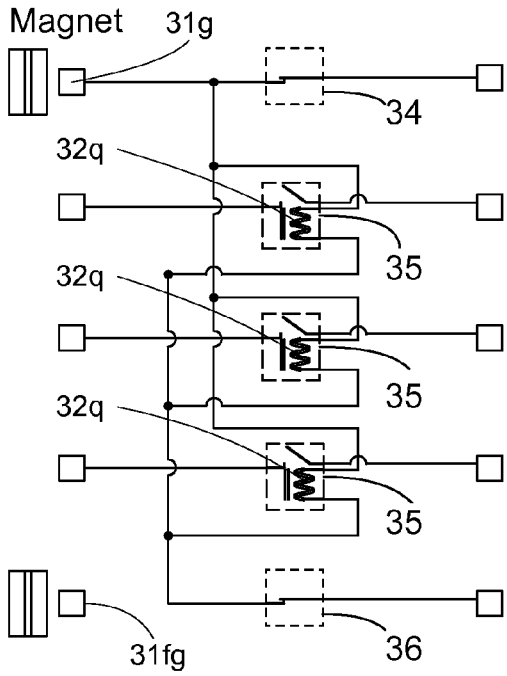
FIG. 12*e* is a schematic electrical diagram of a single column of assemblies of the 1-D strip stationary unit according to the present invention, armed.

FIG. 12*e* is a schematic electrical diagram of a single column of assemblies of the 1-D strip stationary unit (301), according to the present invention, armed.

This state occurs when there are magnets facing ground element (31*g*) and the floating pad (31*fp*), which close all three cantilever version phase/zero element with electromagnet 35 and result in a straight current, when there is a power source, through the three electromagnet coils (32*q*) and magnetizing of the three electromagnet cores (32*p*) of the three electro-magnetic switches, the cantilever version phase/zero element with electromagnet 35.

Figure 12F:
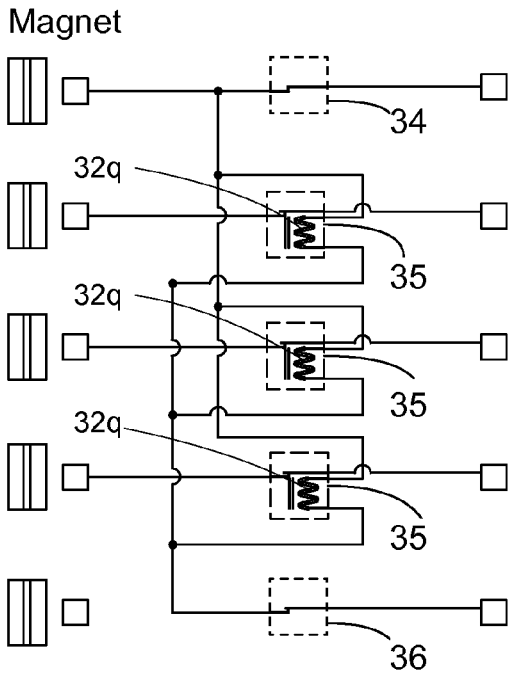

FIG. 12*f* is a schematic electrical diagram of a single column of assemblies of the 1-D strip stationary unit (301), according to the present invention, switched on.

This state occurs when there are magnets facing all five elements of the 1-D apparatus for transferring electrical power element (31), of one column, which close both of the magnetic switches, the cantilever version floating pad element with electromagnet 36, and the electro-magnetic switches 35, and the three electro-magnetic switches, the cantilever version phase/zero element with electromagnet 35.

Figure 13:
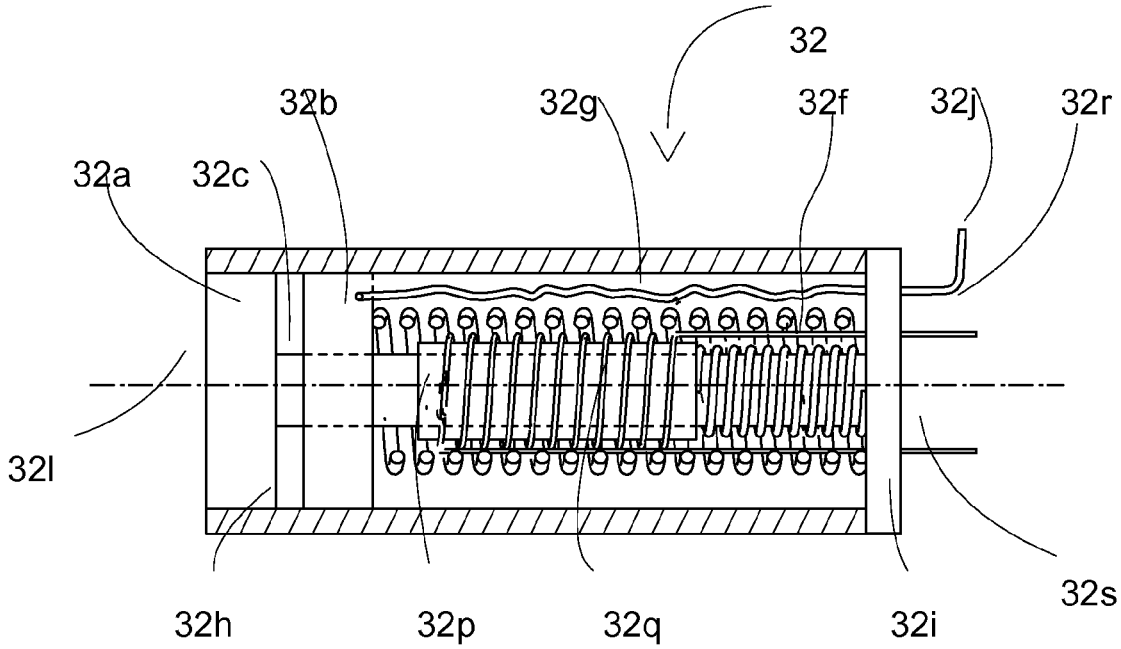
FIG. 13 is a partial cut-away side view schematic illustration of an exemplary, illustrative embodiment of a 1-D strip stationary unit ground assembly 32, according to the present invention.

FIG. 13 is a partial cut-away side view schematic illustration of an exemplary, illustrative embodiment of a 1-D strip stationary unit ground assembly 32, according to the present invention. The structure of 1-D strip stationary unit ground assembly 32 is mostly similar to the structure of planar stationary unit phase switch assembly (10), other than one main difference. 1-D strip stationary unit ground assembly 32 has no planar stationary unit phase assembly magnet (10*e*), but instead has an electro-magnet, which includes an electromagnet core 32*p* and an electromagnet coil 32*q*, both of whose ends have an electromagnet coil first pin 32*r* and an electromagnet coil second pin 32*s*. Also, instead of a planar stationary unit phase wire (10*j*) there is a 1-D strip stationary unit ground assembly voltage element wire 32*j*.

The electromagnet functions as a magnet and provides a magnetic force whose power and direction depend upon the electrical current conducted through the electromagnet coil 32*q*, when there is such a current.

The 1-D strip stationary unit ground assembly 32 also includes a ground element 31*g*, a 1-D strip stationary unit ground assembly shaft 32*c*, a 1-D strip stationary unit ground assembly voltage element 32*b*, a 1-D strip stationary unit ground assembly contact element 32*a*, a 1-D strip stationary unit ground assembly voltage element spring 32*g*, a 1-D strip stationary unit ground assembly magnet spring 32*f*, a 1-D strip stationary unit ground assembly housing 32*h*, and a 1-D strip stationary unit ground assembly housing end disk 32*i*. The 1-D strip stationary unit ground assembly 32 can have a 1-D strip stationary unit ground assembly symmetry axis 32*l*.

Figure 14:
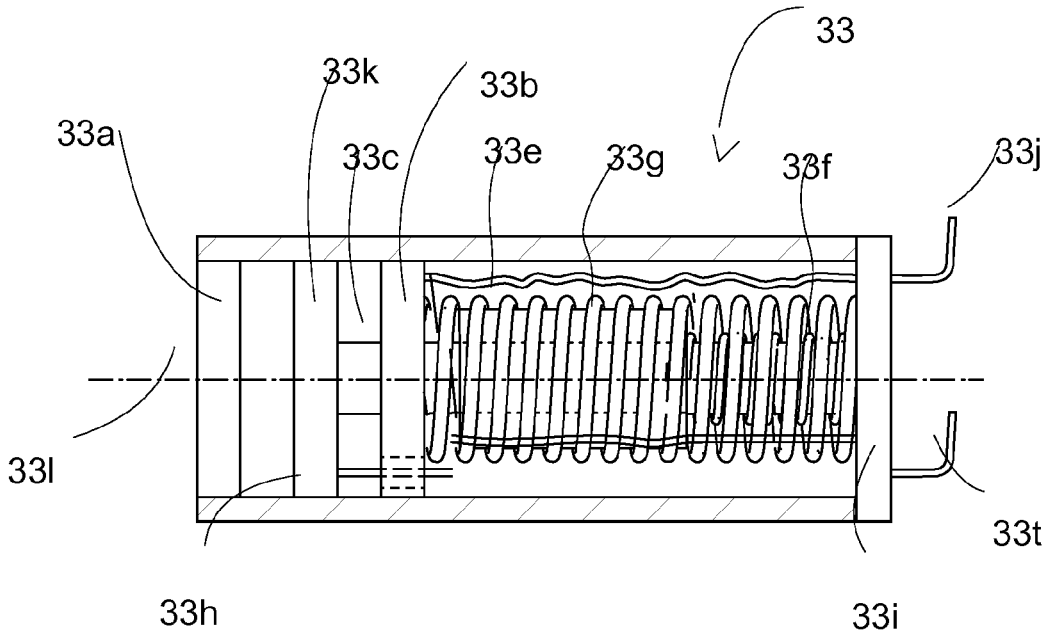
FIG. 14 is a partial cut-away side view schematic illustration of an exemplary, illustrative embodiment of a 1-D strip stationary unit floating pad assembly, according to the present invention.

FIG. 14 is a partial cut-away side view schematic illustration of an exemplary, illustrative embodiment of a 1-D strip stationary unit floating pad assembly 33, according to the present invention. The structure of 1-D strip stationary unit floating pad assembly 33 is also similar to the structure of the planar stationary unit phase switch assembly (10), however, in this instance, instead of the planar stationary unit phase assembly contact element (10*a*), there is a floating pad (31*fp*) which is composed of a nonconductive material, and a 1-D strip stationary unit floating pad assembly contact element 33*a*, which is instead of the planar stationary unit phase assembly voltage element (10*b*), and which is connected to a movable phase element wire 33*j*, where a fixed phase element 33*k* is connected to a fixed phase element wire 33*t*.

When a sufficiently powerful magnetic force is applied to the 1-D strip stationary unit floating pad assembly magnet 33*e*, there is physical contact between the fixed phase element 33*k* and the 1-D strip stationary unit floating pad assembly voltage element 33*b*, and electricity can be conducted between the fixed phase element wire 33*t* and the movable phase element wire 33*j*, under adequate conditions.

Furthermore, the 1-D strip stationary unit floating pad assembly 33 also includes a 1-D strip stationary unit floating pad assembly shaft 33*c*, a 1-D strip stationary unit floating pad assembly magnet spring 33*f*, a 1-D strip stationary unit floating pad assembly voltage element spring 33*g*, a 1-D strip stationary unit floating pad assembly housing 33*h*, and a 1-D strip stationary unit floating pad assembly housing end disk 33*i*.

The 1-D strip stationary unit floating pad assembly 33 can have a 1-D strip stationary unit floating pad assembly symmetry axis 33*l*.

Figure 15A:
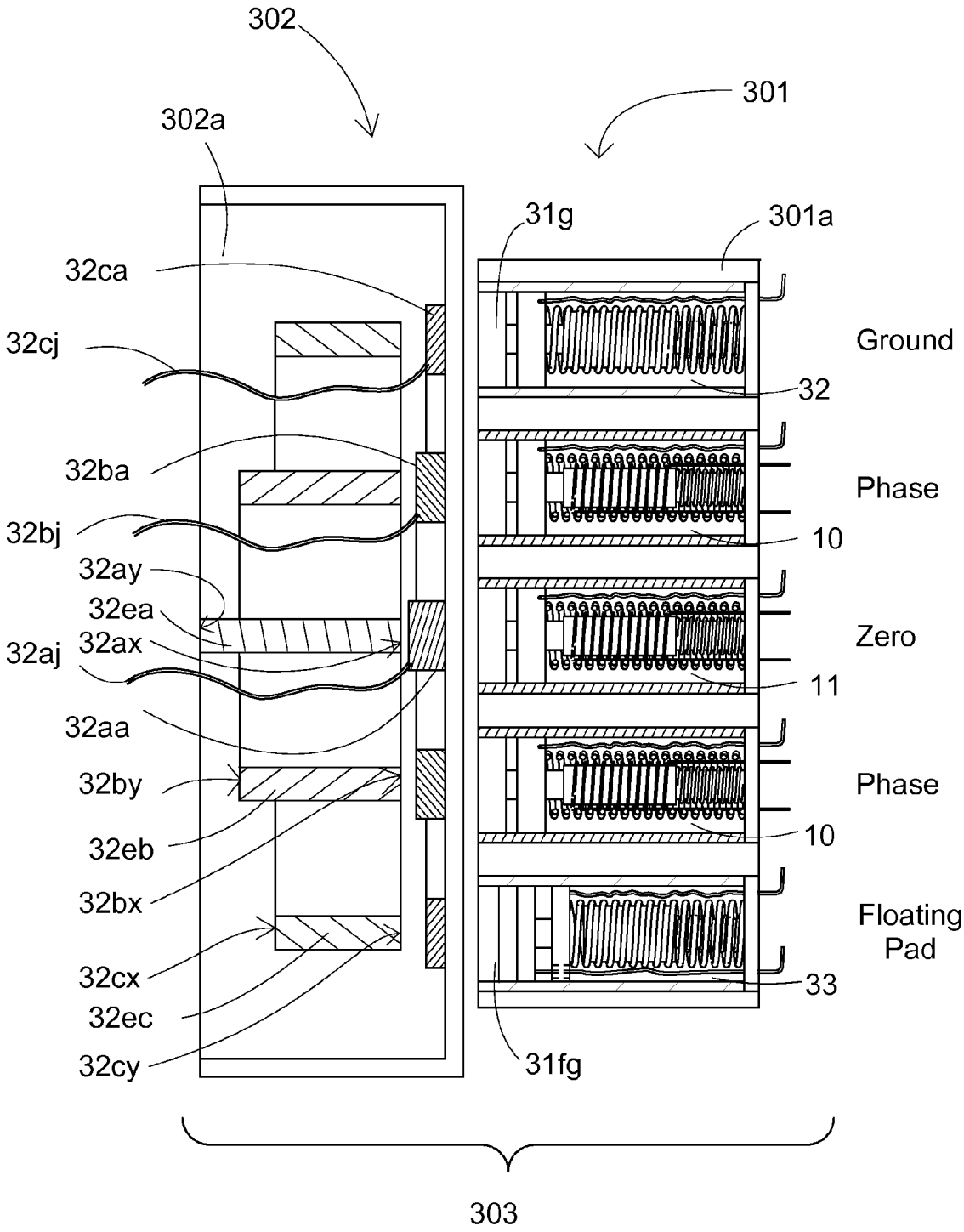
FIG. 15*a* is a partial cut-away side view schematic illustration of an exemplary, illustrative embodiment of an apparatus for transferring AC electrical power having a 1-D strip stationary unit, according to the present invention.

FIG. 15*a* is a partial cut-away side view schematic illustration of an exemplary, illustrative embodiment of apparatus for transferring AC electrical power, with concentric mobile unit 303 having 1-D strip stationary unit 301, according to the present invention.

The apparatus for transferring electrical power with concentric mobile unit 303 includes at least one concentric mobile unit 302.

The 1-D strip stationary unit 301 includes columns, one of which is shown in the present illustration and includes, from the top down, a planar stationary unit phase switch assembly 10, three 1-D strip stationary unit ground assemblies 32, and a 1-D strip stationary unit floating pad assembly 33, whose purposes have been explained in the descriptions of FIGS. 10*ba*, 10*bb*, and 12*c*. Note that the 1-D strip stationary unit 301 can function perfectly well without one of the 1-D strip stationary unit ground assemblies 32, connected to the phase.

The concentric mobile unit 302 includes a concentric mobile unit body 302*a*, in which three magnets are concentrically arranged. Each magnet has magnetic poles, as shown in the present illustration, and all are at a slight distance from a flat wall of the concentric mobile unit body 302*a* which, in action, comes into contact with the 1-D strip stationary unit 301.

The concentric mobile unit zero magnet 32*ea* has a concentric mobile unit zero magnet first magnetic pole 32*ax*, and a concentric mobile unit zero magnet second magnetic pole 32*ay*. The concentric mobile unit phase magnet 32*eb* has a concentric mobile unit phase magnet first magnetic pole 32*bx*, and a concentric mobile unit phase magnet second magnetic pole 32*by*. The concentric mobile unit ground magnet 32*ec* has a concentric mobile unit ground magnet first magnetic pole 32*cx*, and a concentric mobile unit ground magnet second magnetic pole 32*cy*. Facing the magnets, there are three electrical contacts. The sections of the external and central contacts are shaped as rings, and the section of the internal contact is shaped as a circle. Each contact is connected to an electrical conductor when in contact with the contacts of the 1-D strip stationary unit 301.

Concentric mobile unit ground contact element 32*ca* is connected to a concentric mobile unit ground wire 32*cj*, concentric mobile unit phase contact element 32*ba* is connected to a concentric mobile unit phase wire 32*bj*, and concentric mobile unit zero contact element 32*aa* is connected to a concentric mobile unit zero wire 32*aj*.

Figure 15B:
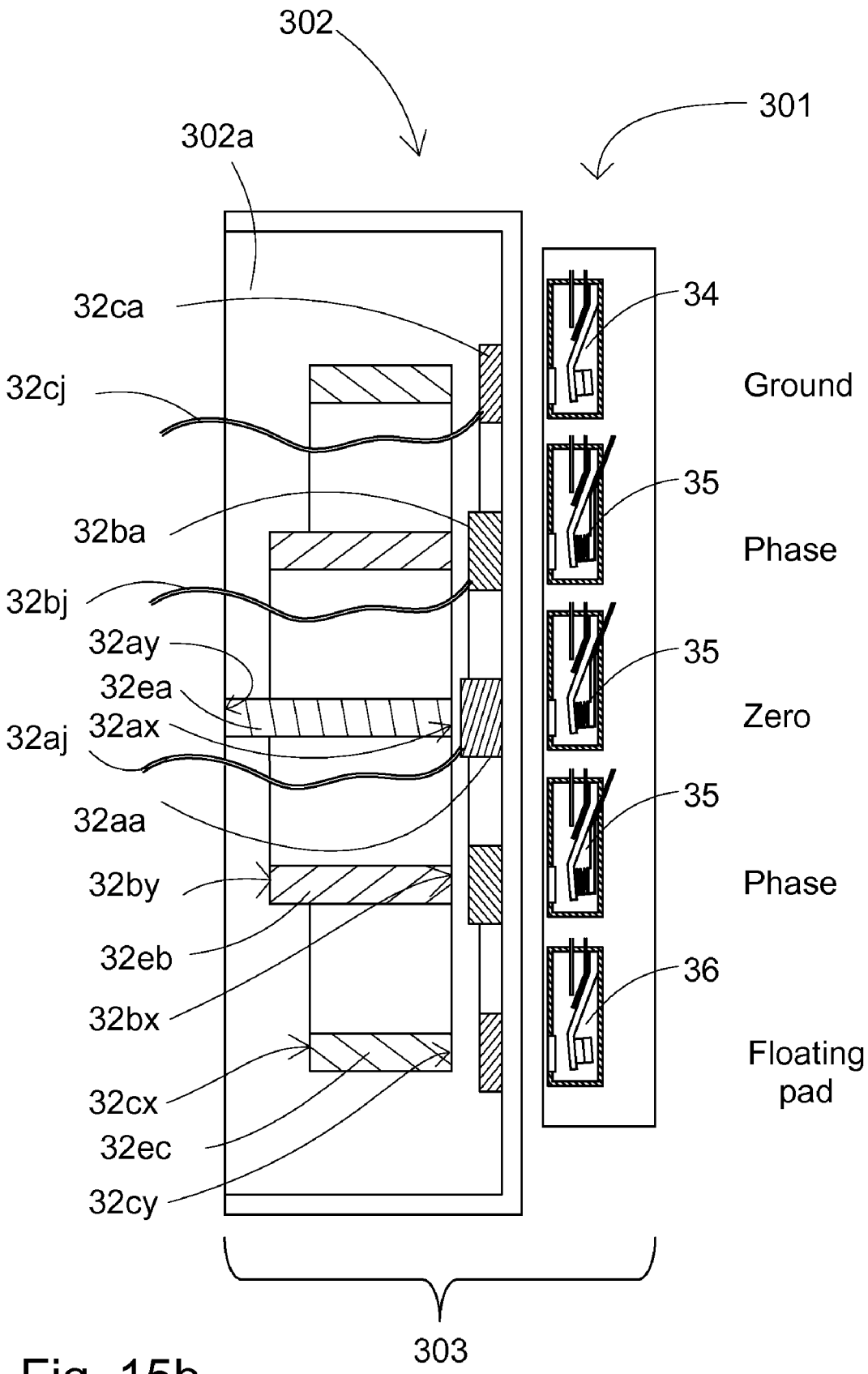
FIG. 15*b* is a partial out-away side view schematic illustration or an exemplary, illustrative embodiment or an apparatus for transferring AC electrical power having a 1-D strip stationary unit, according to the present invention.

FIG. 15*b* is a partial cut-away side view schematic illustration of an exemplary, illustrative embodiment of apparatus for transferring AC electrical power, with concentric mobile unit 303 having 1-D strip stationary unit 301, according to the present invention.

The apparatus for transferring electrical power with concentric mobile unit 303 includes at least one concentric mobile unit 302.

The 1-D strip stationary unit 301 includes columns, one of which is shown in the present illustration and includes, from the top down, cantilever version ground element with magnet 34, three cantilever version phase/zero element with electromagnet 35, and one cantilever version floating pad element with electromagnet 36, whose purposes have been explained in the descriptions of FIG. 12*c*. Note that the 1-D strip stationary unit 301 can function perfectly well without one of the cantilever version phase/zero element with electromagnet 35, connected to the phase.

The concentric mobile unit 302 includes a concentric mobile unit body 302*a*, in which three magnets are concentrically arranged. Each magnet has magnetic poles, as shown in the present illustration, and all are at a slight distance from a flat wall of the concentric mobile unit body 302*a* which, in action, comes into contact with the 1-D strip stationary unit 301.

The concentric mobile unit zero magnet 35*ea* has a concentric mobile unit zero magnet first magnetic pole 35*ax*, and a concentric mobile unit zero magnet second magnetic pole 35*ay*. The concentric mobile unit cantilever version magnet 35*eb* has a concentric mobile unit cantilever version magnet first magnetic pole 35*bx*, and a concentric mobile unit cantilever version magnet second magnetic pole 35*by*. The concentric mobile unit cantilever version phase/zero magnet 35*ec* has a concentric mobile unit cantilever version phase/zero magnet first magnetic pole 35*cx*, and a concentric mobile unit cantilever version phase/zero magnet second magnetic pole 35*cy*. Facing the magnets, there are three electrical contacts. The sections of the external and central contacts are shaped as rings, and the section of the internal contact is shaped as a circle. Each contact is connected to an electrical conductor when in contact with the contacts of the 1-D strip stationary unit 301.

Concentric mobile unit cantilever version phase/zero contact element 35*ca* is connected to a concentric mobile unit cantilever version phase/zero wire 35*cj*, concentric mobile unit cantilever version contact element 35*ba* is connected to a concentric mobile unit cantilever version wire 35*bj*, and concentric mobile unit zero contact element 35*aa* is connected to a concentric mobile unit zero wire 35*aj*.

Figure 16A:
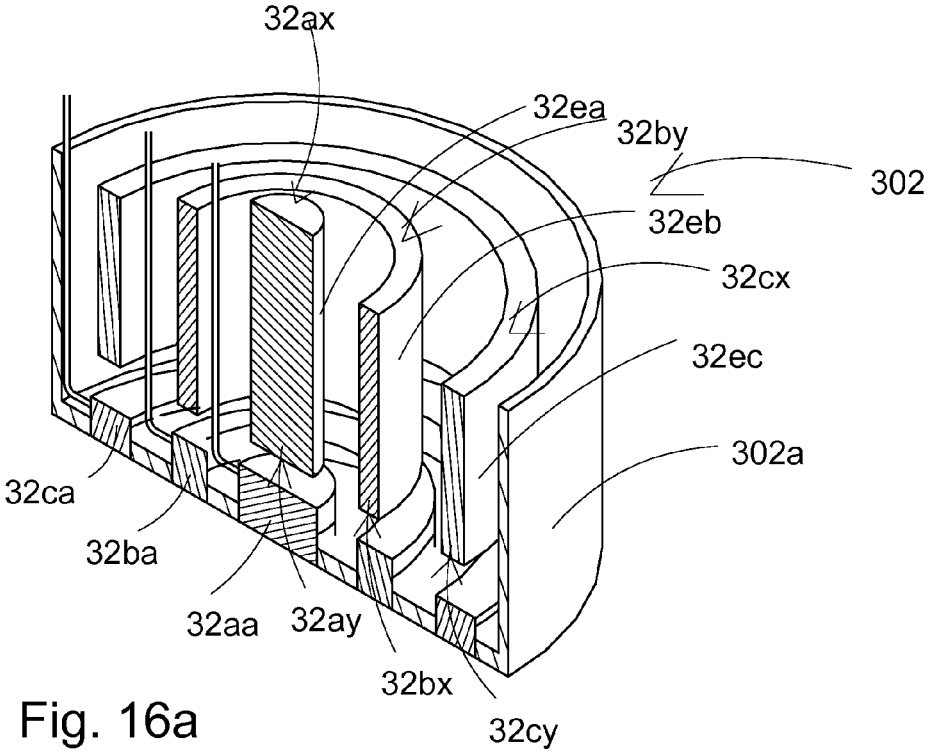
FIG. 16*a* is an isometric view schematic illustration of an exemplary, illustrative embodiment of half of the concentric mobile unit, concentric mobile unit, according to the present invention.

FIG. 16*a* is a isometric view schematic illustration of an exemplary, illustrative embodiment of half of the concentric mobile unit 302, according to the present invention.

The concentric mobile unit 302 includes a concentric mobile unit body 302*a* which has a flat, lower in the present view, base surface designated for contact during activation with 1-D strip stationary unit (301), and it is concentrically set with the concentric mobile unit ground contact element 32*ca*, the concentric mobile unit phase contact element 32*ba*, and the concentric mobile unit zero contact element 32*aa*.

The concentric mobile unit ground magnet 32*ec* faces them, and has a concentric mobile unit ground magnet first magnetic pole 32*cx* and a concentric mobile unit ground magnet second magnetic pole 32*cy*, the concentric mobile unit phase magnet 32*eb* which has a concentric mobile unit phase magnet first magnetic pole 32*bx* and the concentric mobile unit phase magnet second magnetic pole 32*by*, and the concentric mobile unit zero magnet 32*ea* which has a concentric mobile unit zero magnet first magnetic pole 32*ax*, and concentric mobile unit zero magnet second magnetic pole 32*ay*, namely, each magnet has reversed polarity with regard to the adjacent magnet. The present illustration does not show the concentric mobile unit ground wire 32*cj*, the concentric mobile unit phase wire 32*bj*, and the concentric mobile unit zero wire 32*aj*.

Figure 16B:
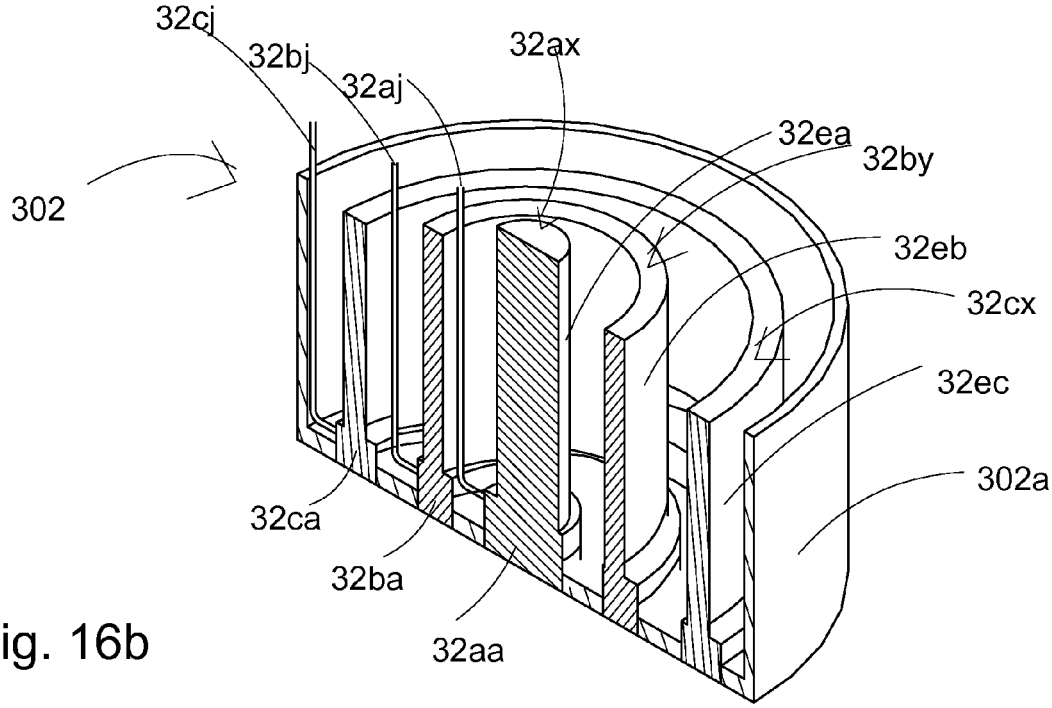
FIG. 16*b* is an isometric view schematic illustration of another exemplary, illustrative embodiment of half of the concentric mobile unit, concentric mobile unit, according to the present invention.

FIG. 16*b* is an isometric view schematic illustration of another exemplary, illustrative embodiment of half of the concentric mobile unit, according to the present invention. According to the embodiment shown in the present illustration, the concentric mobile unit zero magnet 32*ea* touches the concentric mobile unit zero contact element 32*aa* or both can even comprise a single unit, the concentric mobile unit phase magnet 32*eb* touches the concentric mobile unit phase contact element 32*ba* or both can even comprise a single unit, and the concentric mobile unit ground magnet 32*ec* touches the concentric mobile unit ground contact element 32*ca* or both can even comprise a single unit.

Figure 17A:
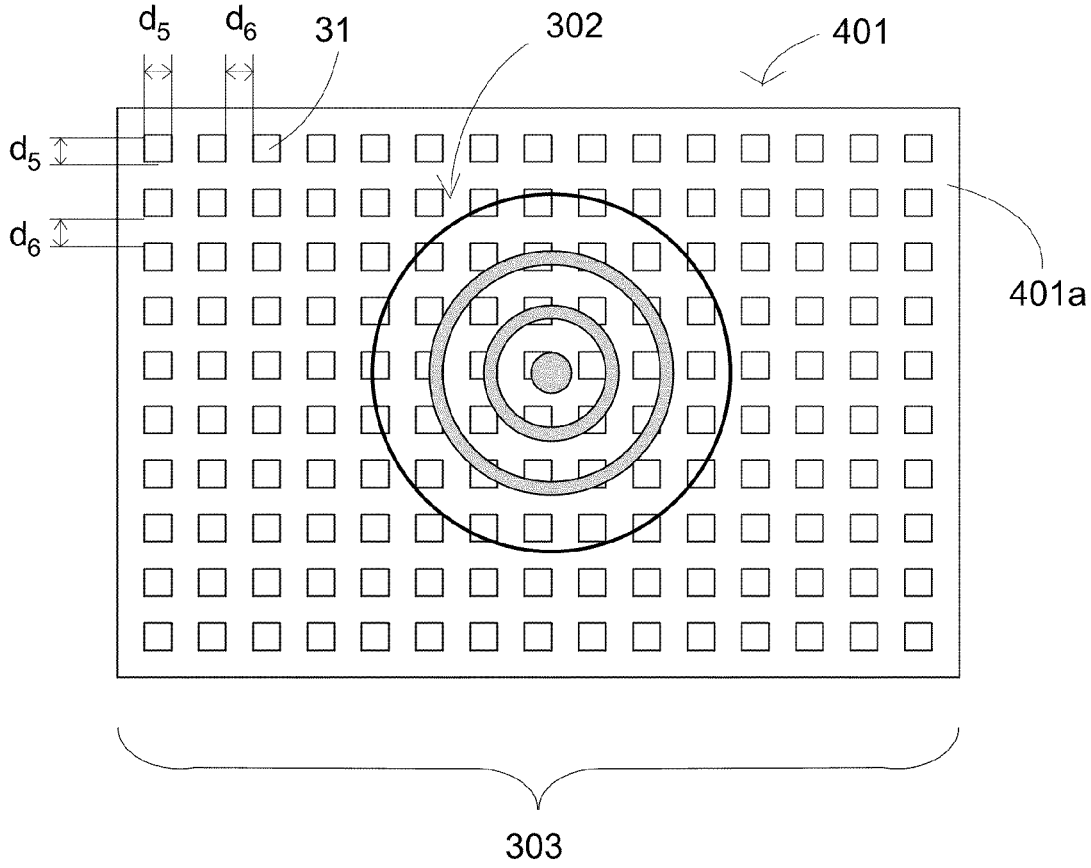
FIG. 17*a* is a schematic top view schematic illustration of an exemplary, illustrative embodiment of an apparatus for transferring AC electrical power having a 2-D strip stationary unit, according to the present invention.

FIG. 17*a* is a schematic top view schematic illustration of an exemplary, illustrative embodiment clan apparatus for transferring AC electrical power, with concentric mobile unit 303 having a 2-D strip stationary unit 401, according to the present invention.

Figure 17B:
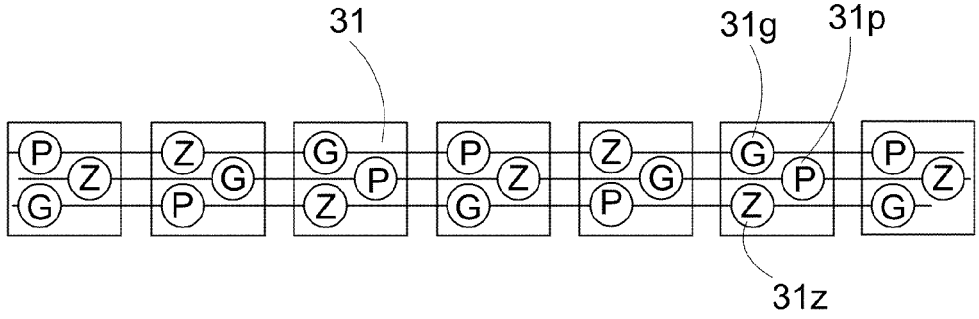
FIG. 17*b* is a schematic top view schematic illustration of an exemplary, illustrative embodiment of one row of elements of a concentric mobile unit, and one elements column of a 2-D strip stationary unit, according to the present invention.

FIG. 17*b* is a schematic top view schematic illustration of an exemplary, illustrative embodiment of one row of elements of a concentric mobile unit (302), and one elements column of a 2-D strip stationary unit (401), according to the present invention.

The matrix is composed of a plurality of 2-D strip stationary unit (401) arranged with a single orientation.

Here each 2-D strip stationary unit (401), except those in the end sides, includes three types of switching elements that can be in contact with of the contact elements of the concentric mobile unit (302).

The three types of switching elements are a ground element 31*g* which is a magnetic double switch element made out of either, a cantilever version of a magnetic double switch (34) or an magnetic double switch (38), a phase element 31*p* made out of either a cantilever version of a electro-magnetic double switch assembly (35) or an electro-magnetic double switch (37), which in this case is an electromagnetic switch element, and a zero element 31*z* made out of either a cantilever version of a electro-magnetic double switch assembly (35) or an electro-magnetic double switch (37) which in this case is electro magnetic switch element.

The ground elements 31*g* are actually double switches with two purposes:

The ground switch 31*g* is a cantilever version of a magnetic double switch (34) or an magnetic double switch (38) with a magnet that when pulled by another magnet with the correct polarization does two things:

Electrically connecting the 1-D apparatus for transferring electrical power element 31 to the ground.

Activating a DC circuit that connects to the electromagnet in the "zero" and "phase" switches next to the ground switch from both sides.

Figure 17C:
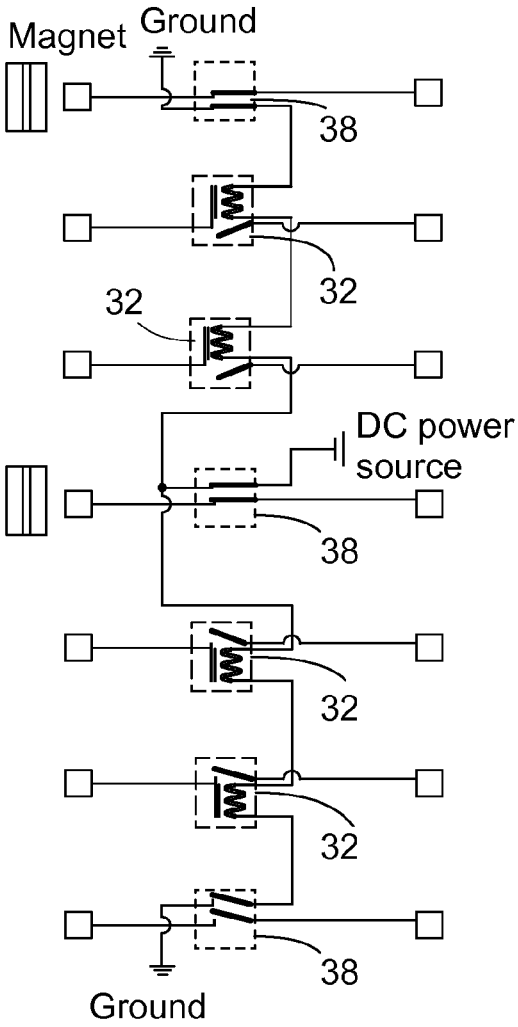
FIG. 17*c* is a schematic electrical diagram of a single column of assemblies of the 2-D array stationary unit according to the present invention, armed.
Figure 17D:
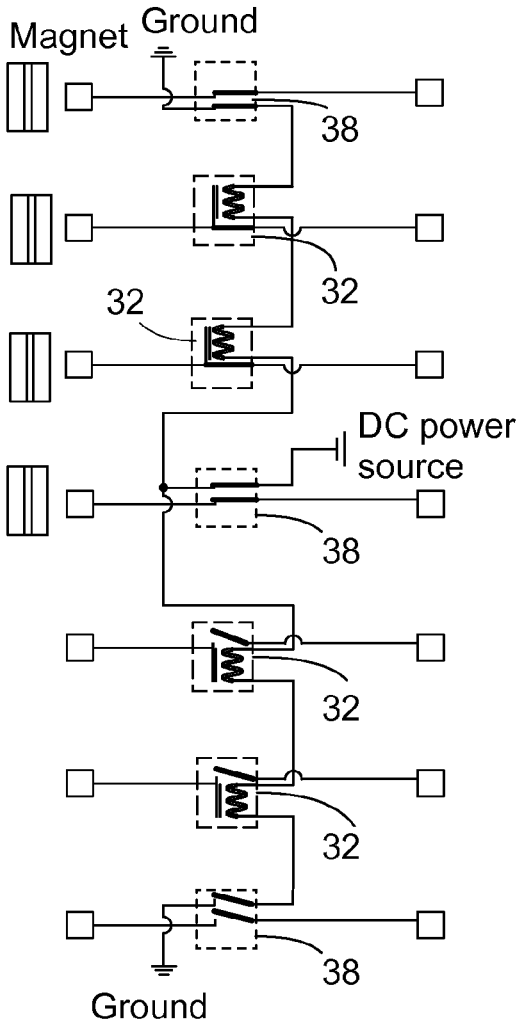
Figure 17E:
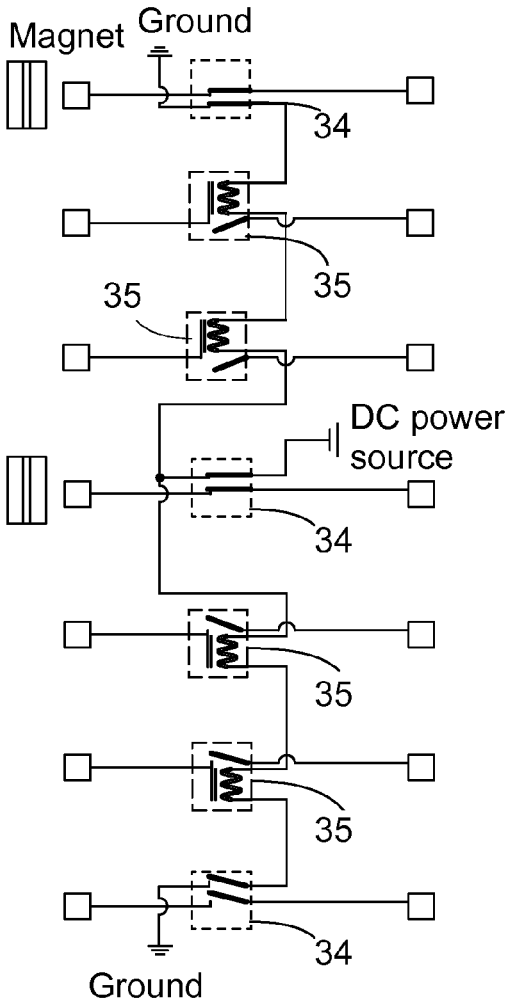

If the ground switch on the other side of the "zero" and "phase" switches is pulled by a magnet with the same polarization the DC circuits that activate the electromagnets in the "zero" and "phase" switches is closed and the electromagnets are activated as described by FIGS. 17*c* and 17*e*.

Figure 17F:
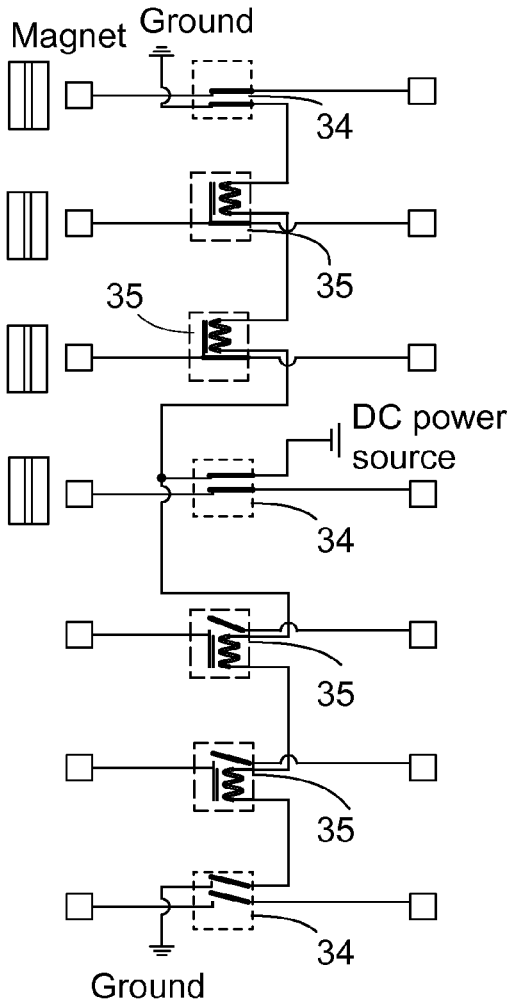

This way, four magnets in a unique arrangement are required to create a power connection as described in FIGS. 17*d* and 17*f*.

This arrangement is then arranged in a form of a matrix as described on FIG. 17*b*.

Figure 18:
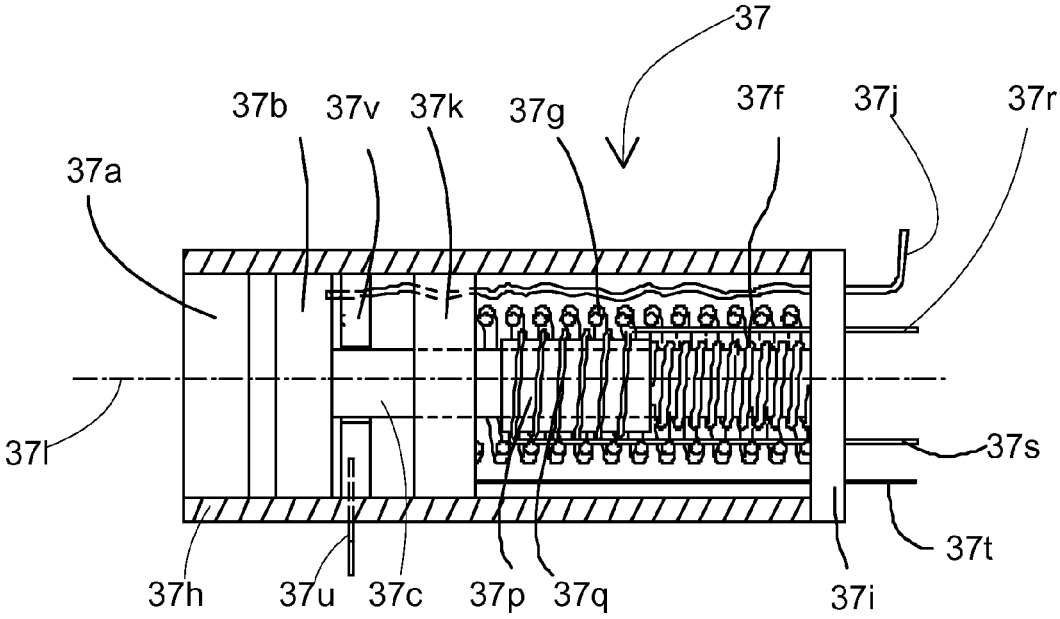
FIG. 18 is a partial cut-away side view schematic illustration of an exemplary, illustrative embodiment of an electro-magnetic double switch, according to the present invention.

FIG. 18 is a partial cut-away side view schematic illustration of an exemplary, illustrative embodiment of an electro-magnetic double switch 37, according to the present invention.

The structure of an electro-magnetic double switch assembly 37 is also similar to the structure of the planar stationary unit phase switch assembly (10), however, in this instance, there is a second contact element, an electro-magnetic double switch assembly DC contact element 37*v* in addition to the electro-magnetic double switch assembly contact element 37*a*.

The electro-magnetic double switch assembly DC contact element 37*v* is making contact with an electro-magnetic double switch assembly DC element 37*k*. When a sufficiently powerful magnetic force is applied to the electro-magnetic double switch assembly electro-magnet 37*p*, and electricity can be conducted between the electro-magnetic double switch assembly DC input wire 37*t* and the electro-magnetic double switch assembly DC output wire 37*u*, under adequate conditions.

Furthermore, the electro-magnetic double switch assembly 37 also includes an electro-magnetic double switch assembly shaft 37*c*, an electro-magnetic double switch assembly magnet spring 37*f*, an electro-magnetic double switch assembly voltage element spring 37*g*, a electro-magnetic double switch assembly housing 37*h*, and a electro-magnetic double switch assembly housing end disk 37*i*.

The electro-magnetic double switch assembly 37 can have an electro-magnetic double switch assembly symmetry axis 37*l*.

Figure 19:
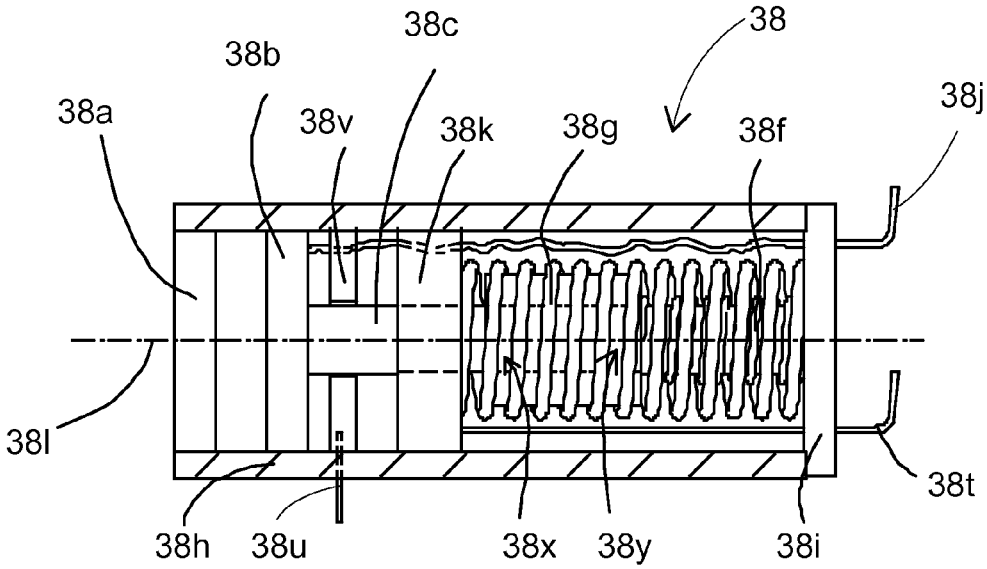
FIG. 19 is a partial cut-away side view schematic illustration of an exemplary, illustrative embodiment of a magnetic double switch, according to the present invention.

FIG. 19 is a partial cut-away side view schematic illustration of an exemplary, illustrative embodiment of a magnetic double switch assembly 38, according to the present invention.

The structure of a magnetic double switch assembly 38 is similar to the structure of the electro-magnetic double switch assembly (37), however, in this instance; the electro-magnetic double switch assembly electromagnet core (37P) is replaced by a magnet with magnetic double switch assembly first magnetic pole 38*x* and magnetic double switch assembly second magnetic pole 38*y*.

The second contact element, the magnetic double switch assembly DC contact element 38*v* is making contact with magnetic double switch assembly DC element 38*k*. When a sufficiently powerful magnetic force is applied to the magnetic double switch assembly electro-magnet 38*p*, and electricity can be conducted between the magnetic double switch assembly DC input wire 38*t* and the magnetic double switch assembly DC output wire 38*u*, under adequate conditions.

Furthermore, the magnetic double switch assembly 38 also includes a magnetic double switch assembly shaft 38*c*, a magnetic double switch assembly electromagnet spring 38*f*, a magnetic double switch assembly voltage element spring 38*g*, a magnetic double switch assembly housing 38*h*, and a magnetic double switch assembly housing end disk 38*i*.

The magnetic double switch assembly 38 can have a magnetic double switch assembly symmetry axis 38*l*.

Figure 20:
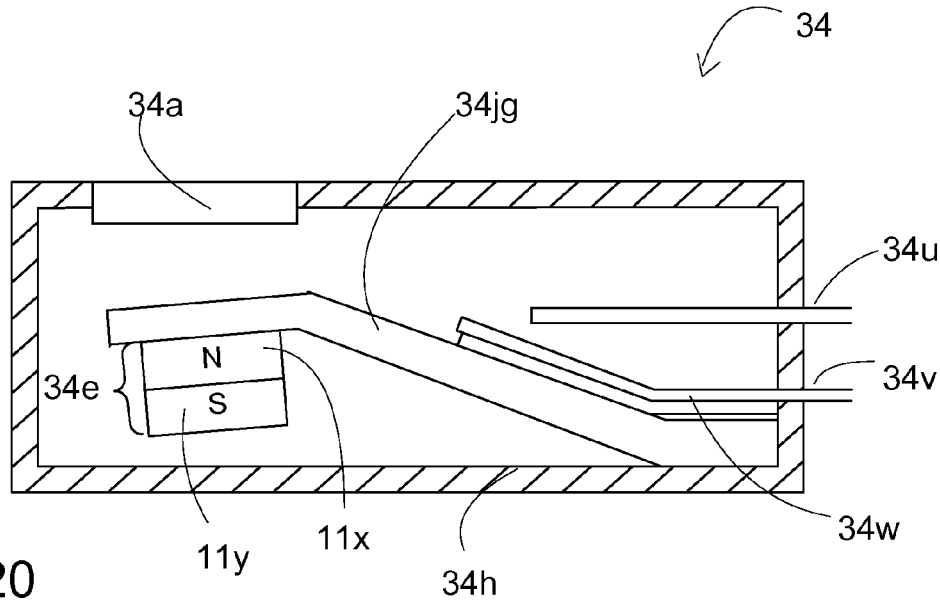
FIG. 20 is a partial cut-away side view schematic illustration of an exemplary, illustrative embodiment of a cantilever version of a magnetic double switch, according to the present invention.

FIG. 20 is a partial cut-away side view schematic illustration of an exemplary, illustrative embodiment of a cantilever version of a magnetic double switch 34, according to the present invention.

The operating concept of cantilever version of a magnetic double switch 34 is the same as in electro-magnetic double switch assembly 37.

However, in this instance, a single element, the cantilever version of a magnetic double switch assembly voltage element wire and assembly voltage element spring 34*jg* is acting as a wire and as a spring.

The cantilever version of a magnetic double switch 34 also includes a cantilever version of a magnetic double switch assembly movable wire 34*v* and a cantilever version of a magnetic double switch assembly isolator 34*w*, and a cantilever version of a magnetic double switch assembly isolator 34*u*, arranged as can be seen at the Figure.

Figure 21:
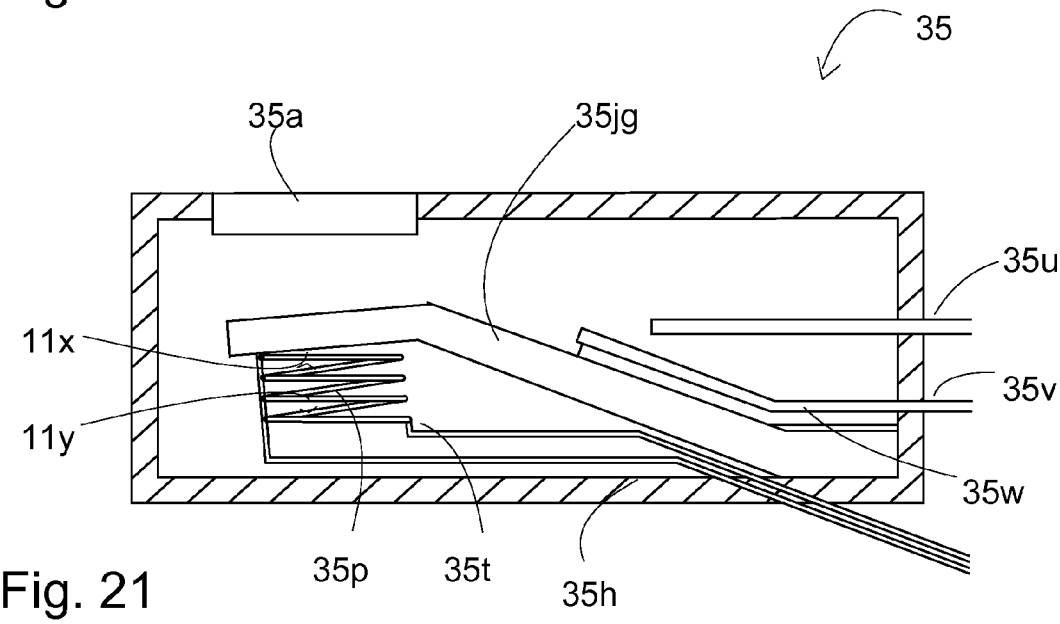
FIG. 21 is a partial cut-away side view schematic illustration of an exemplary, illustrative embodiment of a cantilever version of an electro-magnetic double switch, according to the present invention.
Figure 22:
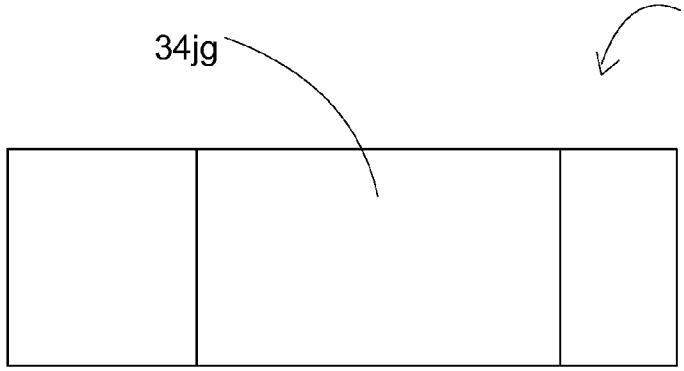
FIG. 22 is a top view schematic illustration of an exemplary, illustrative embodiment of a 1-D strip stationary unit ground assembly voltage element spring, which is also a 1-D strip stationary unit ground assembly voltage element wire, according to the present invention.

FIG. 21 is a partial cut-away side view schematic illustration of an exemplary, illustrative embodiment of a cantilever version of a magnetic double switch 35, according to the present invention.

The operating concept of cantilever version of an electro-magnetic double switch 35 is the same as in the cantilever version of a magnetic double switch 34.

However, in this instance, the cantilever version of a magnetic double switch assembly magnet (34*e*) is replaced by a cantilever version of electro-magnetic double switch assembly coil 35*p*.

Figure 23:
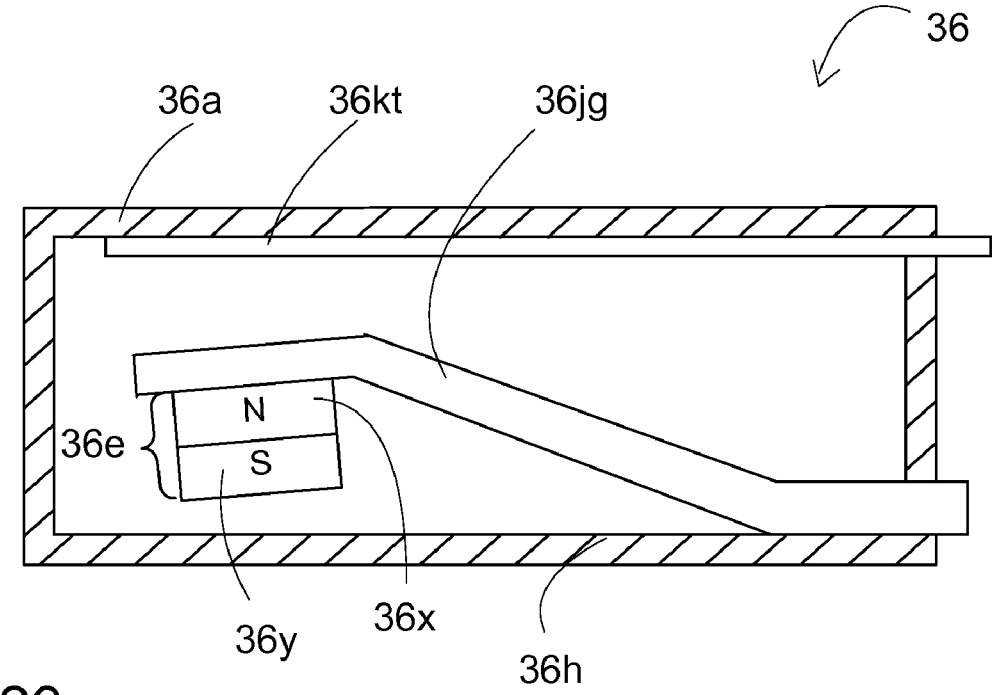
FIG. 23 is a partial cut-away side view schematic illustration of an exemplary, illustrative embodiment of a cantilever version of a magnetic floating pad switch, according to the present invention.

FIG. 23 is a partial cut-away side view schematic illustration of an exemplary, illustrative embodiment of a cantilever version floating pad element with electromagnet 36, according to the present invention.

The operating concept of cantilever version floating pad element with electromagnet 36 is the same as in the cantilever version of a magnetic double switch 34.

However, in this instance, the cantilever version floating pad element contact element 36*a* is made out of a non-conductive material.

Also in this instance, cantilever version floating pad element voltage element wire and assembly voltage element spring 36*jg* is being used to close a DC circuitry and conduct current to the cantilever version floating pad element coil wire 36*kt*

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for transferring alternating current (AC) electrical power (303) comprising:

(a) a concentric mobile unit (302) including:

(i) a concentric mobile unit body (302*a*) having a cylindrical wall and a flat base surface, having a pre-selected outer diameter value ($D_4$);

(ii) a concentric mobile unit ground contact element (32*ca*) disposed concentrically inside said concentric mobile unit body (302*n*) at said base, having said pre-selected outer diameter value ($D_4$);

(iii) a concentric mobile unit phase contact element (32*ba*) disposed concentrically inside said concentric mobile unit body (302*a*) at said base;

(iv) a concentric mobile unit zero contact element (32*aa*) disposed concentrically inside said concentric mobile unit body (302*a*) at said base; and (v) a concentric mobile unit ground magnet (32*ec*) disposed concentrically inside said concentric mobile unit body (302*a*), having a pre-selected outer diameter value ($D_3$).

2. The apparatus for transferring AC electrical power (303) of claim 1 wherein said concentric mobile unit (302) further includes:

(vi) a concentric mobile unit zero magnet (32*ea*) disposed concentrically inside said concentric mobile unit body (302*a*); and (vii) a concentric mobile unit phase magnet (32*eb*) disposed concentrically inside said concentric mobile unit body (302*a*), wherein said concentric mobile unit zero magnet (32*ea*), and said concentric mobile unit zero contact element (32*aa*) are practically one element, wherein said concentric mobile unit phase magnet (32*eb*) and said concentric mobile unit phase contact element 32*ba* are practically one element, and wherein said concentric mobile unit ground magnet 32*ec* and said concentric mobile unit ground contact element 32*ea* are practically one element.

3. The apparatus for transferring AC electrical power (303) of claim 1, wherein said concentric mobile unit (302) further includes:

(vi) a concentric mobile unit zero magnet (32*ea*) disposed concentrically inside said concentric mobile unit body (302*a*); and (vii) a concentric mobile unit phase magnet (32*eb*) disposed concentrically inside said concentric mobile unit body (302*a*), wherein said concentric mobile unit ground magnet (32*ec*) has a concentric mobile unit ground magnet second magnetic pole (32*cy*), facing toward said concentric mobile unit ground contact element (32*ca*), and a concentric mobile unit ground magnet first magnetic pole (32*cx*), wherein said concentric mobile unit phase magnet (32*eb*) has a concentric mobile unit phase magnet first magnetic pole (32*bx*), facing toward said concentric mobile unit phase contact element (32*ba*), and a concentric mobile unit phase magnet second magnetic (pole 32*by*), and wherein said concentric mobile unit zero magnet (32*ea*) has a concentric mobile unit zero magnet second magnetic pole (32*ay*), facing toward said concentric mobile unit zero contact element (32*aa*), and a concentric mobile unit zero magnet first magnetic pole (32*ax*).

4. The apparatus for transferring AC electrical power (303) of claim 3 further comprising:

(b) a one-dimensional strip stationary unit (301) including:

(i) a one-dimensional strip stationary unit body (301*a*) having a flat surface area, in which an array of electrical power elements (31) is set in rows and columns, having a gap having a pre-selected dimensions value ($d_6$) between each adjacent set of said columns and between each adjacent set of said rows, wherein each of said electrical power elements (31) has height and width dimensions of at most pre-selected value ($d_5$), wherein said concentric mobile unit zero magnet (32*ea*) has a pre-selected outer diameter value ($D_1$), wherein said pre-selected outer diameter value ($D_1$) is practically at least one point two times larger than said gap pre-selected dimensions value ($d_6$).

5. The apparatus for transferring AC electrical power (303) of claim 4, wherein each of said columns includes one ground element (31*g*), at least one phase element (31*p*), one zero element (31*z*), and one floating pad (31*fg*), wherein said ground element (31*g*) is a contact element of a planar stationary unit phase switch assembly (10), wherein said phase element (31*p*) is a contact element of a one-dimensional strip stationary unit ground assembly (32), and wherein said floating pad (31*fg*) is a contact element of a one-dimensional strip stationary unit floating pad assembly (33).

6. The apparatus for transferring AC electrical power (303) of claim 5, wherein said planar stationary unit phase switch assembly (10) includes:

a planar stationary unit phase assembly housing (10*h*) having a first end and a second end, and having cylindrical walls;

a planar stationary unit phase assembly contact element (10*a*) disposed at said planar stationary unit phase assembly housing first end;

a planar stationary unit phase switch assembly shaft (10*c*) securely connected to said planar stationary unit phase assembly contact element (10*a*);

a planar stationary unit phase assembly voltage element (10*b*) mounted on said planar stationary unit phase switch assembly shaft (10*c*), having movement capability along at least part of said planar stationary unit phase switch assembly shaft (10*c*); and a planar stationary unit phase assembly magnet (We) mounted on said planar stationary unit phase switch assembly shaft (10*c*), having movement capability along at least part of said planar stationary unit phase switch assembly shaft (10*c*), wherein said one-dimensional strip stationary unit ground assembly (32) includes:

a one-dimensional strip stationary unit ground assembly housing (32) having a first end and a second end, and having cylindrical walls;

a one-dimensional strip stationary unit ground assembly contact element (32*a*) disposed at said planar stationary unit phase assembly housing first end;

a one-dimensional strip stationary unit ground assembly shaft (32*c*) securely connected to said one-dimensional strip stationary unit ground assembly contact element (32*a*);

a one-dimensional strip stationary unit ground assembly voltage element (32*b*) mounted on said one-dimensional strip stationary unit ground assembly shaft (32*c*), having movement capability along at least part of said one-dimensional strip stationary unit ground assembly shaft (32*c*);

an electromagnet core (32*p*) mounted on said one-dimensional strip stationary unit ground assembly shalt (10*e*), having movement capability along at least part of said one-dimensional strip stationary unit ground assembly shaft (32*c*); and an electromagnet coil (32*q*), mounted around said electromagnet core (32*p*):

a one-dimensional strip stationary unit ground assembly voltage element spring (32*g*) one-dimensional strip stationary unit ground assembly voltage element (32*b*);

a one-dimensional strip stationary unit ground assembly magnet spring (32*f*) mounted in contact with said electromagnet core (32*p*), and wherein said one-dimensional strip stationary unit floating pad assembly (33) includes:

a one-dimensional strip stationary unit floating pad assembly housing (33*h*) having a first end and a second end, and having cylindrical walls;

a one-dimensional strip stationary unit floating pad assembly contact element (33*a*) disposed at said planar stationary unit phase assembly housing first end;

a fixed phase element (33*k*) disposed inside said one-dimensional strip stationary unit floating pad assembly housing (33*h*);

a one-dimensional strip stationary unit floating pad assembly shaft (33*c*) securely connected to said fixed phase element (33*k*);

a one-dimensional strip stationary unit floating pad assembly voltage element (33*b*)

mounted on said one-dimensional strip stationary unit floating pad assembly shaft (33*c*), having movement capability along at least part of said one-dimensional strip stationary unit floating pad assembly shaft (33*c*);

a one-dimensional strip stationary unit floating pad assembly magnet (33*e*) mounted on said one-dimensional strip stationary unit floating pad assembly shaft (33*c*), having movement capability along at least part of said one-dimensional strip stationary unit floating pad assembly shaft (33*c*);

a one-dimensional strip stationary unit floating pad assembly voltage element spring (33*g*) mounted in contact with said one-dimensional strip stationary unit floating pad assembly voltage element (33*b*); and a one-dimensional strip stationary unit floating pad assembly magnet spring (33*f*) mounted in contact with said one-dimensional strip stationary unit floating pad assembly magnet (33*e*).

7. The apparatus for transferring AC electrical power (303) of claim 6, wherein at each of said columns said planar stationary unit phase switch assembly (10), said one-dimensional strip stationary unit ground assembly (32), and said one-dimensional strip stationary unit floating pad assembly (33) are electrically connected to an electrical circuit (41), wherein said electrical circuit (41) is electrically connected to a ground source (41*g*), to a phase source (41*p*), to a zero source (41*z*), and to a direct current (DC) source (41*dc*), wherein said electrical circuit (41), has a switched off mode, an armed mode and a switched on mode.

8. The apparatus for transferring AC electrical power (303) of claim 7, wherein said electrical circuit (41) includes two magnetic switches (31*a*) for conducting a straight current, electrically connected serially to at least two electro-magnetic switches (31*b*), which are electrically connected to each other, and are designated to conduct an alternating current.

9. The apparatus for transferring AC electrical power (303) of claim 3 further comprising:

(b) a two-dimensional strip stationary unit (401) including:

(i) a two-dimensional strip stationary unit body (401*a*) having a flat surface urea, in which an array of electrical power elements (31) is set in rows and columns, having a gap having a pre-selected dimensions value ($d_6$) between each adjacent set of said columns and between each adjacent set of said rows, wherein each of said electrical power elements (31) has height and width dimensions of at most pre-selected value ($d_5$), wherein said concentric mobile unit zero magnet (32*ea*) pre-selected outer diameter value ($D_1$), is practically at least one point two times larger than said gap pre-selected dimensions value ($d_6$).

10. The apparatus for transferring AC electrical power (303) of claim 9, wherein each of said columns includes at least one ground element (31*g*), at least one phase element (31*p*), at least one zero element (31*z*), and at least one floating pad (31*fg*), wherein said ground element (31*g*) is a one-dimensional strip stationary unit ground assembly (32), wherein said phase element (31*p*) is a planar stationary unit phase switch assembly (10), wherein said zero element (31*z*), is a planar stationary unit zero assembly (11), and wherein said floating pad (31*fg*) is a one-dimensional, strip stationary unit floating pad assembly (33).

11. The apparatus for transferring AC electrical power (303) of claim 10, wherein said planar stationary unit phase switch assembly (10) includes:

a planar stationary unit phase assembly housing (10*h*) having a first end and a second end, and having cylindrical walls;

a planar stationary unit phase assembly contact element (10*a*) disposed at said planar stationary unit phase assembly housing first end;

a planar stationary unit phase switch assembly shaft (10*c*) securely connected to said planar stationary unit phase assembly contact element (10*a*);

a planar stationary unit phase assembly voltage element (10*b*) mounted on said planar stationary unit phase switch assembly shalt (10*e*), having movement capability along at least part of said planar stationary unit phase switch assembly shaft (10*e*); and a planar stationary unit phase assembly magnet (10*e*) mounted on said planar stationary unit phase switch assembly shalt (10*c*), having movement capability along at least part of said planar stationary unit phase switch assembly shaft (10*c*), wherein said one-dimensional strip stationary unit ground assembly (32) includes:

a one-dimensional strip stationary unit ground assembly housing (32) having a first end and a second end, and having cylindrical walls;

a one-dimensional strip stationary unit ground assembly contact element (32*a*) disposed at said planar stationary unit phase assembly housing first end;

a one-dimensional strip stationary unit ground assembly shaft (32*c*) securely connected to said one-dimensional strip stationary unit ground assembly contact element (32*a*);

a one-dimensional strip stationary unit ground assembly voltage element (32*b*) mounted on said one-dimensional strip stationary unit ground assembly shaft (32*c*), having movement capability along at least part of said one-dimensional strip stationary unit ground assembly shaft (32*c*);

an electromagnet core (32*p*) mounted on said one-dimensional strip stationary unit ground assembly shall (10*c*), having movement capability along at least part of said one-dimensional strip stationary unit ground assembly shall (32*c*); and an electromagnet coil (32*q*), mounted around said electromagnet core (32*p*);

a one-dimensional strip stationary unit ground assembly voltage element spring (32*g*) one-dimensional strip stationary unit ground assembly voltage element (32*b*);

a one-dimensional strip stationary unit ground assembly magnet spring (32*f*) mounted in contact with said electromagnet core (32*p*), and wherein said one-dimensional strip stationary unit floating pad assembly (33) includes:

a one-dimensional strip stationary unit floating pad assembly housing (33*h*) having a first end and a second end, and having cylindrical walls;

a one-dimensional strip stationary unit floating pad assembly contact element (33*a*) disposed at said planar stationary unit phase assembly housing first end;

a fixed phase element (33*k*) disposed inside said one-dimensional strip stationary unit floating pad assembly housing (33*h*);

a one-dimensional strip stationary unit floating pad assembly shaft (33*c*) securely connected to said fixed phase element (33*k*);

a one-dimensional strip stationary unit floating pad assembly voltage element (33*b*)

mounted on said one-dimensional strip stationary unit floating pad assembly shaft (33*c*), having movement capability along at least part of said one-dimensional strip stationary unit floating pad assembly shaft (33*e*);

a one-dimensional strip stationary unit floating pad assembly magnet (33*c*) mounted on said one-dimensional strip stationary unit floating pad assembly shaft (33*c*), having movement capability along at least part of said one-dimensional strip stationary unit floating pad assembly shaft (33*c*);

a one-dimensional strip stationary unit floating pad assembly voltage element spring (33*g*) mounted in contact with said one-dimensional strip stationary unit floating pad assembly voltage element (33*b*); and a one-dimensional strip stationary unit floating pad assembly magnet spring (33*f*) mounted in contact with said one-dimensional strip stationary unit floating pad assembly magnet (33*e*).

12. The apparatus for transferring AC electrical power (303) of claim 9, wherein each of said columns includes at lest least one ground element (31*g*), at least one phase element (31*p*), at least one zero element (31*z*), and at least one floating pad (31*fg*), wherein said ground element (31*g*) is a cantilever version ground element with magnet (34), wherein said phase element (31*p*) is a cantilever version phase/zero element with electromagnet (35), wherein said zero element (31*z*), is a cantilever version phase/zero element with electromagnet (35), and wherein said floating pad (31*fg*) is a cantilever version floating pad element with electromagnet (36).

* * * * *